US005259357A

United States Patent [19]

Shimizu et al.

[11] Patent Number: 5,259,357

[45] Date of Patent: Nov. 9, 1993

[54] IGNITION SYSTEM FOR INTERNAL COMBUSTION ENGINE

[75] Inventors: Kiyoshi Shimizu; Hidezou Umiyama; Kazuya Iwamoto, all of Saitama, Japan

[73] Assignee: Honda Giken Kogyo Kabushiki Kaisha, Tokyo, Japan

[21] Appl. No.: 979,788

[22] Filed: Nov. 20, 1992

[30] Foreign Application Priority Data

Nov. 22, 1991 [JP] Japan ..... 3-307908

[51] Int. Cl.[5] ..... F02P 15/08

[52] U.S. Cl. ..... 123/638

[58] Field of Search ..... 123/638, 211

[56] References Cited

U.S. PATENT DOCUMENTS

| | | | |
|---|---|---|---|
| 3,935,844 | 2/1976 | Nishimiya et al. | 123/638 |
| 4,091,615 | 5/1978 | Hayashi et al. | 123/638 |
| 4,100,736 | 7/1978 | Nakajima et al. | 123/638 |
| 4,133,330 | 1/1979 | Nakajima et al. | 123/638 |
| 4,170,212 | 10/1979 | Mori et al. | 123/211 |
| 4,202,306 | 5/1980 | Nakajima et al. | 123/638 |
| 4,459,804 | 7/1984 | Nakajima et al. | 123/638 |
| 4,517,952 | 5/1985 | Hosoya | 123/638 |

FOREIGN PATENT DOCUMENTS

| | | | |
|---|---|---|---|
| 0345879 | 3/1989 | European Pat. Off. | 123/638 |
| 9114867 | 3/1991 | Fed. Rep. of Germany . | |
| 5263531 | of 0000 | Japan | 123/638 |
| 5612476 | of 0000 | Japan | 123/638 |

OTHER PUBLICATIONS

English language Abstract & European Search Report.

*Primary Examiner*—Raymond A. Nelli

*Attorney, Agent, or Firm*—Lyon & Lyon

[57] ABSTRACT

An ignition system for an internal combustion engine that has at least two spark plugs for each of the cylinders. The number of spark plugs ignited is controlled in accordance with the operational condition of the engine. The system includes an ignition control means for controlling the ignition in such a manner that an all-point ignition in which all the spark plugs are ignited is carried out in a condition where the temperature of the engine is equal to or lower than a predetermined value, and so that a decreased number-point ignition in which the ignition of at least one of the spark plugs is discontinued is carried out in a condition where the temperature of the engine is higher than the predetermined value. By selecting the two-point ignition in a low temperature region in which the temperature of the cooling water is low, reductions in fuel firing performance and combustion speed are prevented, and by selecting the one-point ignition in a high temperature region in which the temperature of the cooling water is high, an increase in the amount of NOx due to excessively high combustion speed is prevented. The ignition may also be controlled on the basis of engine load and exhaust gas recirculation valves.

14 Claims, 22 Drawing Sheets

IGNITION SYSTEM FOR INTERNAL COMBUSTION ENGINE

BACKGROUND OF THE INVENTION

1. Field of the Invention

The present invention relates to an ignition system for an internal combustion engine, and particularly, to an ignition system having at least two spark plugs for each of the cylinders, in which the number of spark plugs ignited is controlled in accordance with an operational condition of the engine.

2. Description of the Prior Art

There are conventionally known ignition systems having two spark plugs provided for each of cylinders in an internal combustion engine, wherein the switching-over of a two-point ignition in which both of the two spark plugs are ignited and a one-point ignition in which only one of the two spark plugs is ignited, is controlled in accordance with the magnitude of the load on the internal combustion engine, thereby providing a reduction in the amount of nitrous oxides (NOx) in the exhaust gas (see Japanese Patent Application Laid-open Nos. 63531/77 and 124676/81).

In a condition in which the temperature of the internal combustion engine is low, the air-fuel ratio is varied due to an increase in the amount of fuel adhering to the intake pipe and/or an insufficient atomization of the fuel, thereby resulting in an unstable firing performance provided by the spark plugs.

In an internal combustion engine including an intake valve opening and closing control mechanism for controlling the opening and closing timing of an intake valve to control the amount of air drawn in accordance with the demand load, the period of opening of the intake valve is shortened remarkably during an extremely low load operation, such as during idling, and after closing of the intake valve, a longer adiabatic expansion period is started and followed by a compression stroke. For this reason, the temperature during the compression is not increased sufficiently, resulting in an unstable firing performance provided by the spark plugs.

SUMMARY OF THE INVENTION

Accordingly, it is an object of the present invention to provide an ignition system for an internal combustion engine, wherein an appropriate firing performance can be provided in accordance with various operational conditions of the internal combustion engine.

To achieve the above object, according to a first aspect and feature of the present invention, there is provided an ignition system for an internal combustion engine, having at least two spark plugs for each of the cylinders, the number of spark plugs that are ignited being controlled in accordance with an operational condition of the engine, wherein the system includes an ignition control means for controlling the ignition in such a manner that an all-point ignition in which all the spark plugs are ignited is carried out in a condition where the temperature of the engine is equal to or lower than a predetermined value, and that a decreased number-point ignition in which the ignition of at least one of the spark plugs is discontinued is carried out in a condition where the temperature of the engine is higher than the predetermined value.

With the above first feature of the present invention, the all-point ignition by the plurality of spark plugs is carried out when the temperature of the engine is lower than the predetermined value. Therefore, the fuel firing performance can be improved, and the fuel combustion speed can be increased, thereby providing a reduced variation in combustion during a lower temperature operation of the engine. In addition, the decreased number-point ignition is carried out when the temperature of the engine is equal to or higher than the predetermined value. Therefore, it is possible to avoid the disadvantage that the fuel combustion speed is too high and the amount of harmful substances in an exhaust gas is increased.

In addition, according to a second aspect and feature of the present invention, there is provided an ignition system in an internal combustion engine, comprising at least two spark plugs for each of the cylinders, the number of spark plugs that are ignited being controlled in accordance with an operational condition of the engine, wherein the system includes an ignition control means for controlling the ignition in such a manner that an all-point ignition in which all the spark plugs are ignited is carried out in a condition where the amount of exhaust gas recirculation (EGR) is equal to or more than a predetermined value.

With the above second feature of the present invention, the all-point ignition is carried out when the amount of EGR in the internal combustion engine is equal to or more than the predetermined value. Therefore, it is possible to achieve reductions not only in combustion variation, in fuel consumption and in the amount of hydrocarbons (HC) in the region of a large amount of EGR, but also in the amount of NOx in the region of a small amount of EGR.

Further, according to a third aspect and feature of the present invention, there is provided an ignition system for an internal combustion engine, having at least two spark plugs for each of the cylinders and an intake valve opening and closing control mechanism for controlling the opening and closing timing of an intake valve to control the amount of air drawn into a cylinder in accordance with the required load, the number of spark plugs ignited being controlled in accordance with an operational condition of the engine, wherein the system includes an ignition control means for controlling the ignition in such a manner that an all-point ignition in which all the spark plugs are ignited is carried out in a condition where the load on the engine is equal to or lower than a predetermined value, and a reduced number-point ignition in which the ignition of at least one of the spark plugs is discontinued is carried out in a condition where the load on the engine is higher than the predetermined value.

With the above third feature of the present invention, the all-point ignition is carried out when the load on the engine is equal to or lower than the predetermined value. Therefore, even if a drop in temperature of the intake gas occurs due to the shortening of the period of opening of the intake valve when the load on the engine is low, the fuel firing performance and the fuel combustion speed can be maintained to prevent an increase in variation of combustion. In addition, because the reduced number-point ignition is carried out when the load on the engine is higher than the predetermined value, it is possible to reduce the amount of harmful substances in the exhaust gas.

In addition to the third feature, a fourth feature of the present invention is that the ignition control means performs the all-point ignition, irrespective of the load on the engine, in a condition where the temperature of the engine is equal to or lower than a predetermined value.

With the above fourth feature of the present invention, the all-point ignition by the spark plugs is carried out irrespective of the load on the engine, when the temperature of the engine is equal to or lower than the predetermined value. Therefore, the fuel firing performance can be improved, and the fuel combustion speed can be increased, thereby providing a reduced variation in combustion during a lower temperature operation of the engine.

In addition to the first to fourth features, a fifth feature of the present invention is that the ignition control means performs the all-point ignition, irrespective of the engine temperature and load on the engine, when the engine is in a fuel-cutting condition.

With the above fifth feature of the present invention, because the all-point ignition is carried out, irrespective of the engine temperature and load on the engine, when the engine is in the fuel-cutting condition, it is possible to prevent a reduction in firing performance due to fouling of the spark plugs.

Yet further, according to a sixth aspect and feature of the present invention, there is provided an ignition system in an internal combustion engine, having at least two spark plugs for each of the cylinders, the ignition of at least one of the spark plugs being discontinued in accordance with the operational condition of the engine, wherein the system includes an ignition control means for controlling the ignition to alternate the discontinuance of ignition of the spark plug with that of another spark plug at intervals of a predetermined period of time.

With the above sixth feature of the present invention, because the discontinuance of ignition of the spark plug is alternated with that of another spark plug at intervals of a predetermined period of time, it is possible to uniformize the number of ignitions of the plurality of spark plugs mounted for each cylinder to improve the durability thereof. Moreover, the discontinuance of ignition of only one particular spark plug is avoided, which prevents fouling of such spark plug to improve the firing performance.

The above and other objects, features and advantages of the invention will become apparent from the following description of preferred embodiments, taken in conjunction with the accompanying drawings.

DESCRIPTION OF THE PREFERRED EMBODIMENTS

The present invention will now be described by way of preferred embodiments in connection with the accompanying drawings with reference to a typical four (4) cylinder in-line engine with a single intake valve and a single exhaust valve for each cylinder and a specific type of valve operating and operation-modifying mechanism, but it will readily appear to those skilled in the art that this invention may be used with other sizes and types of engines, valve arrangements and valve-operating mechanisms.

Figure 1:
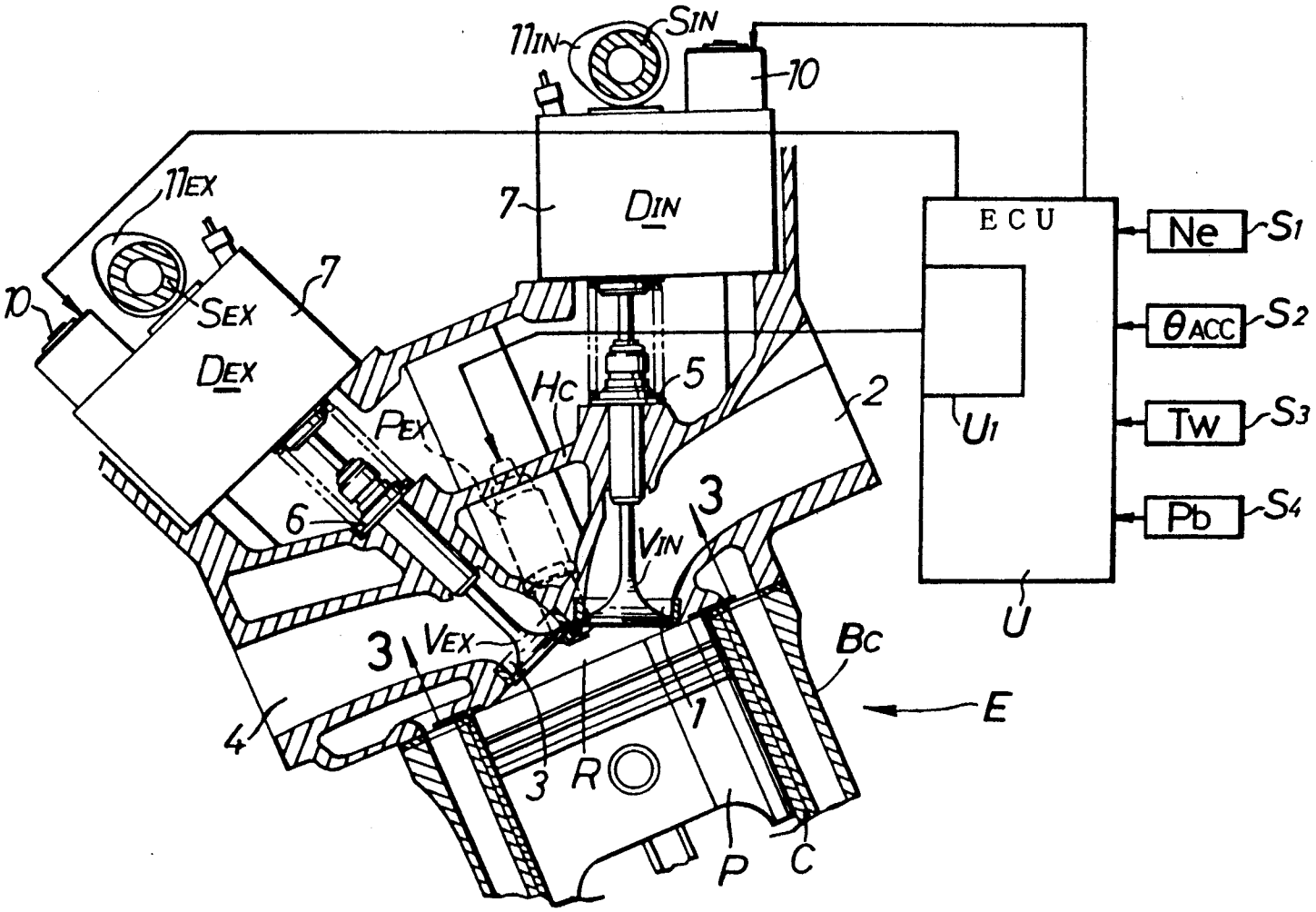
FIG. 1 is a partially sectional elevation view of an internal combustion engine.
Figure 2:
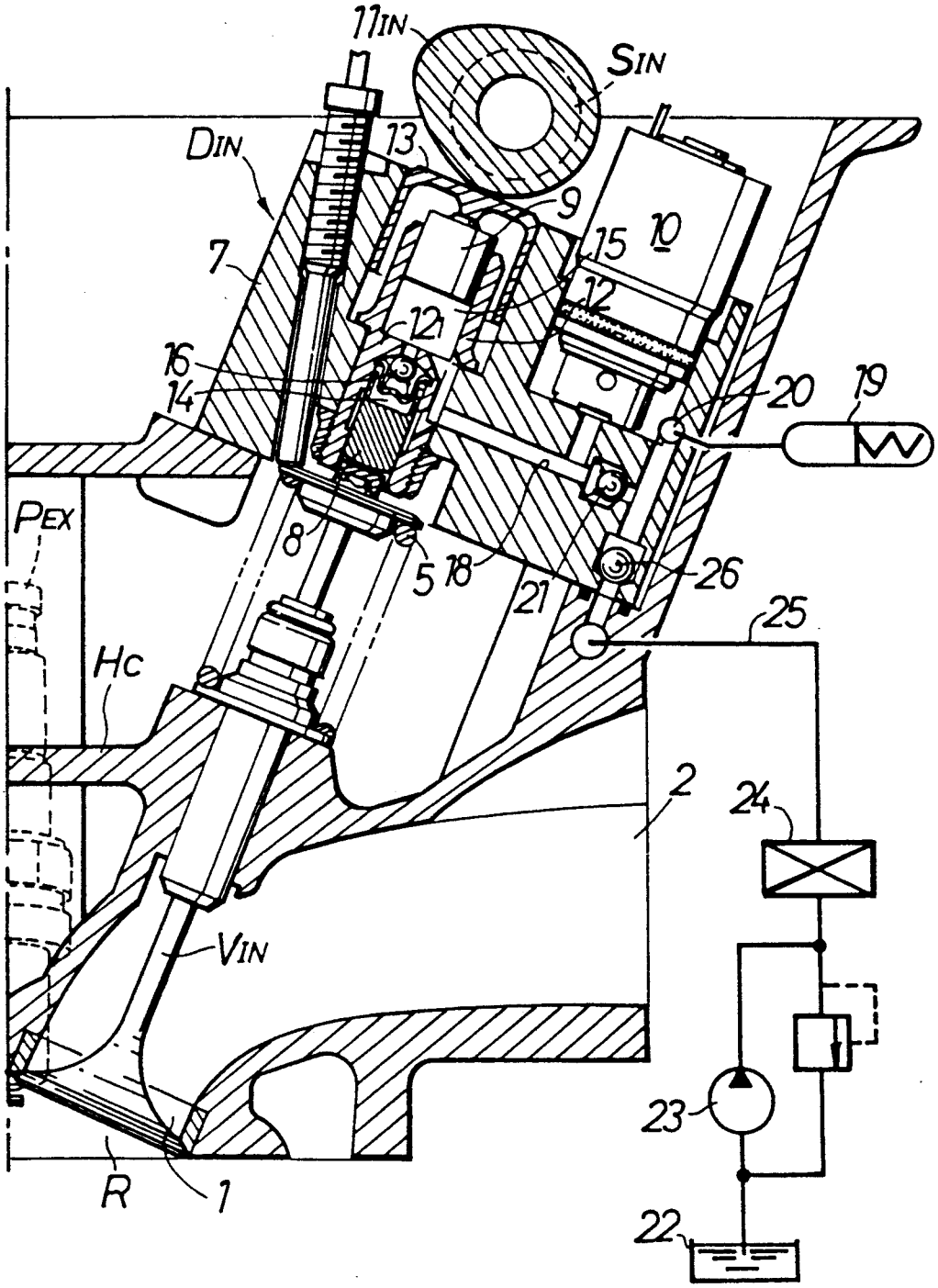
FIG. 2 is an enlarged view of an essential portion shown in FIG. 1.
Figure 3:
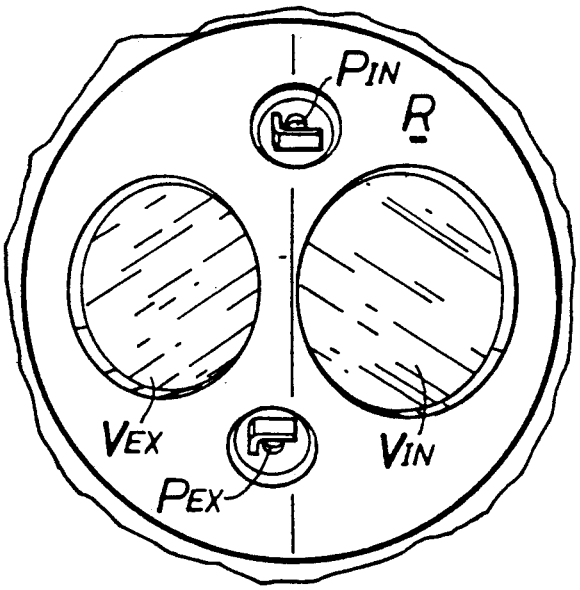
FIG. 3 is a sectional bottom view taken along a line 3—3 in FIG. 1.

Referring to FIGS. 1 to 3, four cylinders C (only one of which is shown) are arranged side by side in a cylinder block Bc in a 4-cylinder internal combustion engine E. A combustion chamber R is defined between a piston P slidably received in each of the cylinders C and a cylinder head Hc coupled to a top surface of the cylinder block Bc. The cylinder head Hc is provided, at a portion thereof corresponding to each of the cylinders C, with a single intake valve bore 1 opened into a ceiling surface of the combustion chamber R, an intake port 2 connected to the intake valve bore 1, a single exhaust valve bore 3 opened into the ceiling surface of the combustion chamber R, and an exhaust port 4 connected to the exhaust valve bore 3. Further, the cylinder head Hc is provided with an intake valve $V_{IN}$ for opening and closing the intake valve bore 1 and an exhaust valve $V_{EX}$ for opening and closing the exhaust valve bore 3 for intake and exhaust opening and closing movements. A valve spring 5 is compressed between the intake valve $V_{EX}$ and the cylinder head Hc for biasing the intake valve $V_{EX}$ in a closing direction. A valve spring 6 is compressed between the exhaust valve $V_{EX}$ and the cylinder head Hc for biasing the exhaust valve $V_{EX}$ in a closing direction. A single intake-side spark plug $P_{IN}$ and a single exhaust-side spark plug $P_{EX}$ are disposed in the cylinder head Hc at the ceiling of the combustion chamber R.

An intake valve cam shaft $S_{IN}$ and an exhaust valve cam shaft $S_{EX}$ are rotatably carried in an upper portion of the cylinder head Hc. The intake valve cam shaft $S_{IN}$ extends in the direction of the arrangement of the cylinders C to have an axis perpendicular to an extension of the axis of the intake valve $V_{IN}$ and is operatively connected to a crankshaft (not shown) at a reduction ratio of ½. The exhaust valve cam shaft $S_{EX}$ extends in the direction of the arrangement of the cylinders C to have an axis perpendicular to an extension of the axis of the exhaust valve $V_{EX}$ and is operatively connected to the crankshaft (not shown) at a reduction ratio of ½.

A hydraulic drive unit $D_{IN}$ is disposed between the intake valve cam shaft $S_{IN}$ and the intake valve $V_{IN}$ for each of the cylinders C. And a hydraulic drive unit $D_{EX}$ is disposed between the exhaust valve cam shaft $S_{EX}$ and the exhaust valve $V_{EX}$ for each of the cylinders C.

The hydraulic drive unit $D_{IN}$ for driving the intake valve $V_{IN}$ to open and close the latter comprises a valve-driving piston 8, a cam follower piston 9 and a hydraulic pressure release valve 10, all of which are provided with the intake valve $V_{IN}$ for each of the cylinders C and are disposed in a support block 7 coupled to the cylinder head Hc in association with each of the cylinders C. An intake cam $11_{IN}$ individually corresponding to the intake valve $V_{IN}$ is integrally provided on the intake valve cam shaft $S_{IN}$ at a location corresponding to each of the cylinders C.

A cylinder body 12 is fixed in the support block 7 coaxially with and above the intake valve $V_{IN}$. A bottomed cylindrically formed lifter 13 is slidably received in an upper portion of the support block 7 on the same axis as the cylinder body 12 to come into sliding contact with the cam $11_{IN}$. The cylinder body 12 is basically formed into a cylindrical shape having a partition wall 12, at an axially intermediate portion thereof. The valve-driving piston 8 is slidably received in a lower portion of the cylinder body 12 to define a hydraulic pressure chamber 14 between the piston 8 and the partition wall 12. The cam follower piston 9 is slidably received in an upper portion of the cylinder body 12 to define a hydraulic pressure generating chamber 15 between the piston 9 and the partition wall 12.

A front end, i.e., a lower end, of the valve-driving piston 8 abuts against a rear, i.e., upper, end of the corresponding intake valve $V_{IN}$. Thus, the valve-driving piston 8 is operatively connected to the intake valve $V_{IN}$ with its back facing the hydraulic chamber 14. A rear end, i.e., an upper end of the cam follower piston 9 abuts against the lifter 13. Thus, the cam follower piston 9 is driven axially through the lifter 13 by the rotation of the intake cam $11_{IN}$, so that a hydraulic pressure corresponding to the rotation of the intake valve cam shaft $S_{IN}$ is generated in the hydraulic pressure generating chamber 15 to which a front, i.e., lower, surface of the cam follower piston 9 faces.

The hydraulic pressure generating chamber 15 and the hydraulic pressure chamber 14 are in communication with each other, until the intake valve $V_{IN}$ is fully opened from a state in which it is lifted from a fully closed position by a predetermined amount. In addition, until the intake valve $V_{IN}$ is lifted by a predetermined amount from the fully closed position, the hydraulic pressure generating chamber 15 and the hydraulic pressure chamber 14 are in communication with each other through a check valve 16 for permitting only a flow of a working oil from the hydraulic pressure generating chamber 15 to the hydraulic pressure chamber 14 as well as a constriction mechanism for restraining the amount of working oil returned from the hydraulic pressure chamber 14 to the hydraulic pressure generating chamber 15. The constriction mechanism is comprised of a notch provided in a sidewall of the cylinder body 12, and a notch provided in an upper end of the valve-driving piston 8, so that a resistance is provided to a flow of the working oil returned from the hydraulic pressure chamber 14 to the hydraulic pressure generating chamber 15 through a constriction formed by the alignment of both the notches.

In the fully closed state of the intake valve $V_{IN}$, the hydraulic drive unit $D_{IN}$ is in a state shown in FIG. 2. If the lifter 13 is urged downwardly from the state shown in FIG. 2 by the intake cam $11_{IN}$ in response to the rotation of the cam shaft $S_{IN}$, the cam follower piston 9 is urged downwardly by the lifter 13. This causes the volume of the hydraulic pressure generating chamber 15 to be reduced, and the working oil is introduced into the hydraulic pressure chamber 14 through the check valve 16 and the constriction mechanism. Thus, the hydraulic pressure in the hydraulic pressure chamber 14 is increased to urge the valve-driving piston 8 downwardly, thereby causing the intake valve $V_{IN}$ to be opened against a spring force of the valve spring 5. If the urging force applied to the lifter 13 by the intake cam $11_{IN}$ is released after the intake valve $V_{IN}$ is brought into its fully opened state, the intake valve $V_{IN}$ is driven upwardly, i.e., in the closing direction by the spring force of the valve spring 5. This closing operation of the intake valve $V_{IN}$ causes the valve driving piston 8 also to be urged upwardly. Thus, the working oil in the hydraulic pressure chamber 14 is returned to the hydraulic pressure generating chamber 15, but in the latter half of the valve closing stroke, the check valve 16 and the constriction mechanism are interposed between the hydraulic pressure chamber 14 and the hydraulic pressure generating chamber 15. Therefore, the amount of working oil returned from the hydraulic pressure chamber 14 to the hydraulic pressure generating chamber 15 is restrained by the constriction mechanism, so that the speed of upward movement, i.e., closing movement of the intake valve $V_{IN}$ is reduced from the middle of the valve-closing operation. This allows the shock generated upon seating to be moderated.

If the hydraulic pressures in the hydraulic pressure chamber 14 and the hydraulic pressure generating chamber 15 are released, the hydraulic pressure chamber 14 loses a transmitting function to open the intake valve $V_{IN}$ by overcoming the spring force of the valve spring 5. Thus, even if the intake cam $11_{IN}$ continues to urge the lifter 13 downwardly, the intake valve $V_{IN}$ starts the closing movement under the influence of the resilient force of the valve spring 5, so that the volume of the hydraulic pressure chamber 14 is reduced.

The hydraulic pressure release valve 10 is a solenoid valve for controlling the releasing timing of the hydraulic oil from the hydraulic pressure chamber 14 and the hydraulic pressure generating chamber 15, i.e., for controlling the lift amount of the intake valve $V_{IN}$ and the closing timing of the intake valve $V_{IN}$. The hydraulic pressure release valve 10 is interposed between an oil passage 18 provided in the support block 7 to communicate with the hydraulic pressure chamber 14 and an oil passage 20 provided in the support block 7 to communicate with an accumulator 19 disposed in the support block 7. A one-way valve 21 is disposed in the support block 7 between the oil passages 18 and 20 to bypass the hydraulic pressure release valve 10. The one-way valve 21 is opened to permit only a flow of the oil from the accumulator 19 toward the oil passage 18, i.e., toward the hydraulic pressure chamber 14, when the hydraulic pressure in the oil passage 20 is larger than that in the oil passage 18 by a preset pressure or more. An oil pump 23 for pumping the working oil from an oil reservoir 22 or an oil pan provided in the cylinder head Hc is connected to the oil passage 20. The oil pump 23 is connected to an oil passage 25 which includes a filter 24 provided therein and which is connected to the oil passage 20 through a check valve 26 disposed in the support block 7. The check valve 26 permits only a flow of the working oil from the oil pump 23 toward the oil passage 20.

When the internal combustion engine E is in a low load operation, the hydraulic pressures in the hydraulic pressure chamber 14 and the hydraulic pressure generating chamber 15 escape through the oil passage 18 and the hydraulic pressure release valve 10 into the accumulator 19 by controlling the hydraulic pressure release valve 10 for opening thereof in the latter half of the closing stroke of the intake valve $V_{IN}$. Therefore, the intake valve $V_{IN}$ is closed rapidly by the spring force of the valve spring 5, resulting in a shortened period in which the intake valve $V_{IN}$ is in an opened state.

The hydraulic drive unit $D_{EX}$ for driving the exhaust valve $V_{EX}$ for opening and closing the latter basically has the same construction and function as the hydraulic drive unit $D_{IN}$ and, hence, the duplicate description thereof is omitted.

Connected to an electronic control unit U are an engine revolution-number sensor $S_1$ for detecting the number Ne of revolutions per unit of time of the crankshaft of the engine, a throttle opening degree sensor $S_2$ for detecting the throttle opening degree $\Theta_{ACC}$ of the air intake throttle valve (not shown), a water-temperature sensor $S_3$ for detecting the temperature $T_W$ of the cooling water circulated through the engine, and an intake pressure sensor $S_4$ for detecting the intake negative pressure Pb in the air intake manifold. The opening and closing of the hydraulic pressure release valve 10 and the ignition of the intake and exhaust spark plugs $P_{IN}$ and $P_{EX}$ are controlled by the electronic control unit U.

Figure 4:
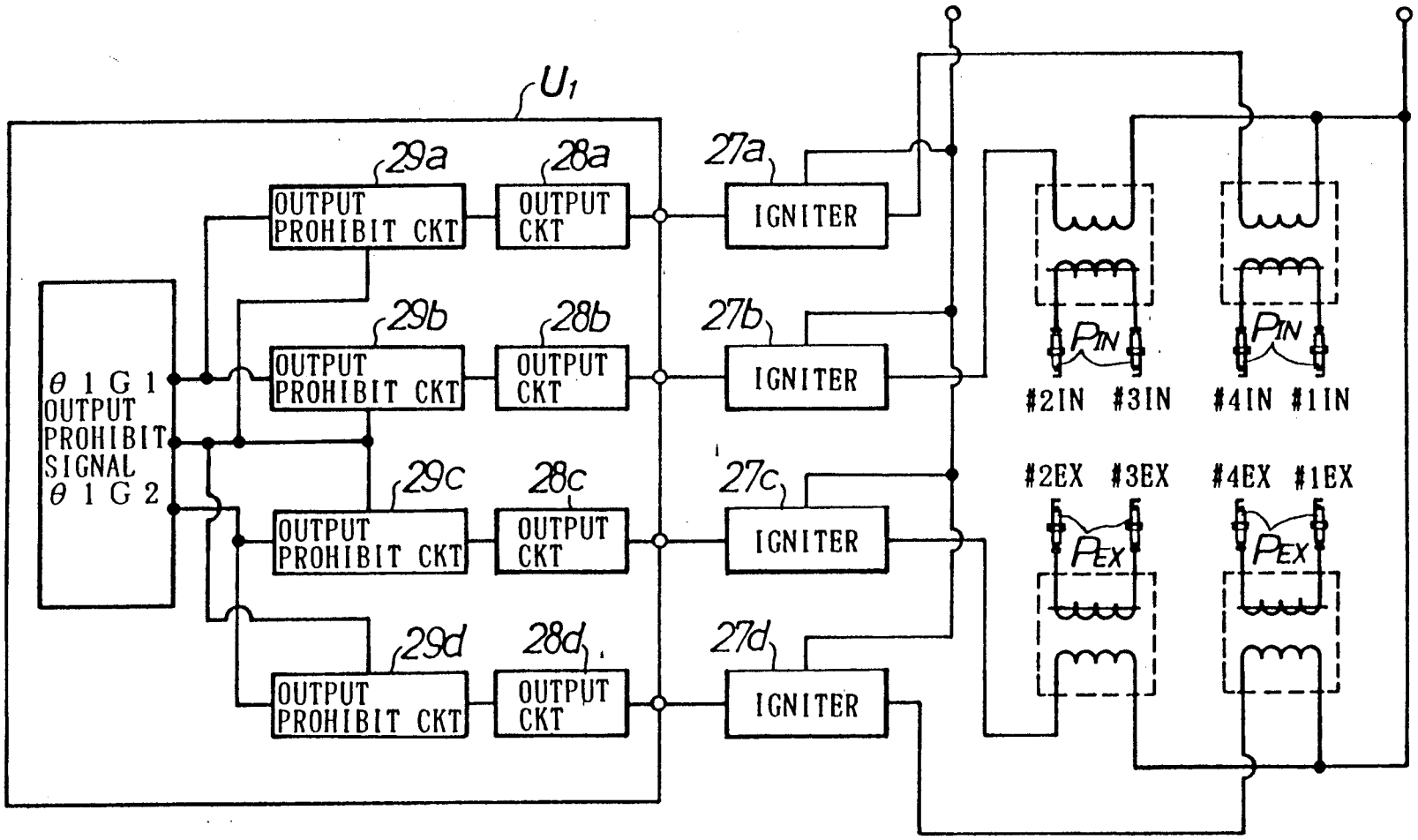
FIG. 4 is a block diagram illustrating an ignition system having an ignition control means.

As is shown in FIG. 4, the two intake spark plugs $P_{IN}$ for the #4 and #1 cylinders the two intake spark plugs $P_{IN}$ for the #2 and #3 cylinders, the two exhaust spark plugs $P_{EX}$ for the #2 and #3 cylinders and the two exhaust spark plugs $P_{EX}$ for the #4 and #1 cylinders are connected to four corresponding igniters 27*a* to 27*d*, respectively. An ignition control means $U_1$ provided in the electronic control unit U comprises output circuits 28*a* to 28*d*, each of which is operated by an ignition signal and which are connected to the 30 igniters 27*a* to 27*d*, respectively. Output prohibit circuits 29*a* and 29*b* are connected to the two output circuits 28*a* and 28*b*, respectively, corresponding to the intake spark plugs $P_{IN}$. Output prohibit circuits 29*c* and 29*d* are connected to the two output circuits 28*c* and 28*d*, respectively, corresponding to the exhaust spark plugs $P_{EX}$. These output prohibit circuits 29*a*, 29*b*, $29_c$ and 29*d* selectively prohibit the operation of the two output circuits 28*a* and 28*b* for the intake ignition plugs $P_{IN}$ or the two output circuits 28*c* and 28*d* for the exhaust spark plugs $P_{EX}$ on the basis of output prohibit signals, respectively. Thus, when no output prohibit signal is received, the intake spark plug $P_{IN}$ and the exhaust spark plug $P_{EX}$ of each cylinder are ignited together. When the output prohibit signal is received, the ignition of each intake ignition plug $P_{IN}$ is discontinued and only each exhaust spark plug $P_{EX}$ is ignited in the first to third embodiments of this invention, and the ignition of each intake ignition plug $P_{IN}$ is used and each exhaust spark plug $P_{EX}$ is discontinued periodically in the fourth embodiment.

The operation of the first embodiment of the present invention will be described below.

Figure 5:
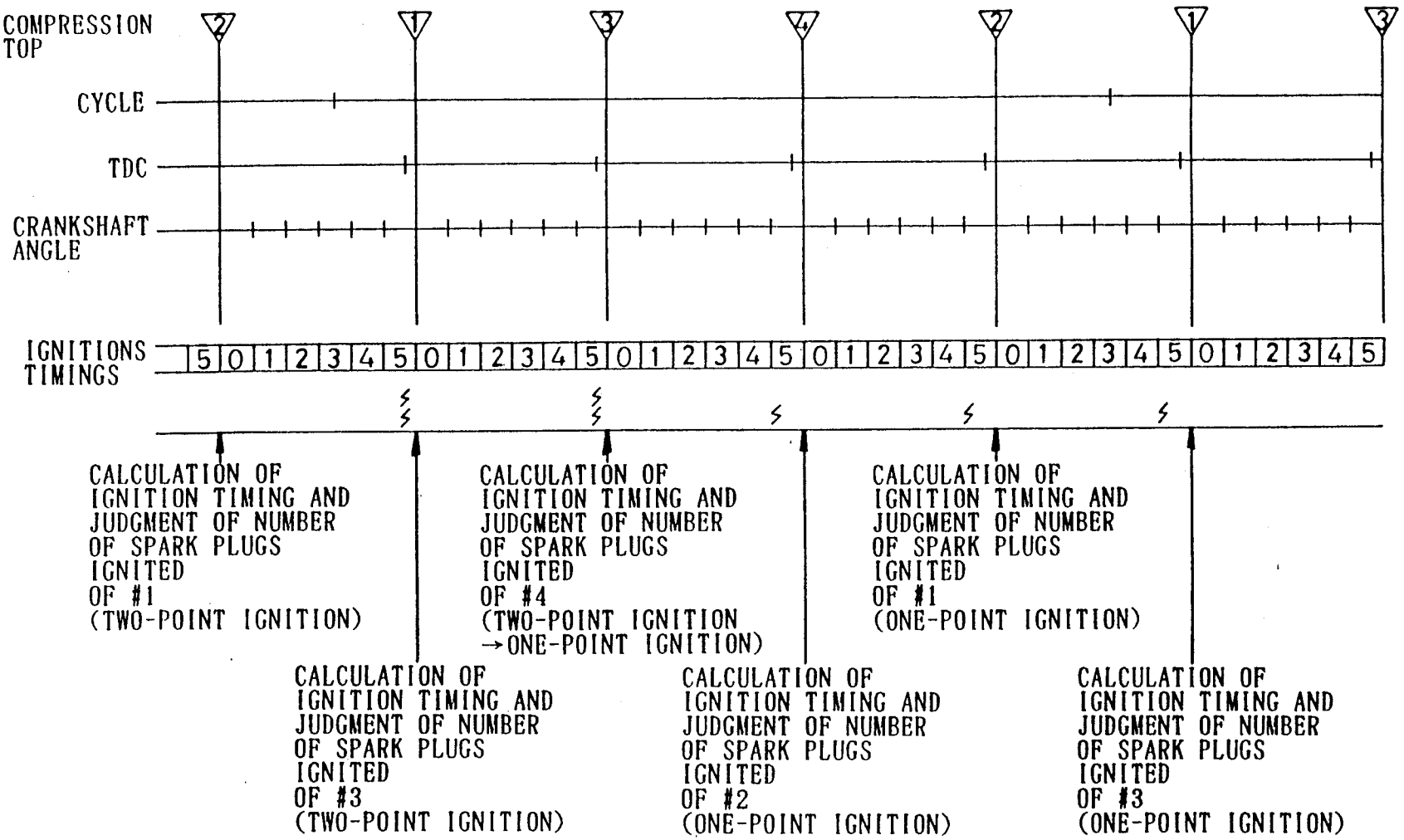
FIGS. 5 and 6 are time charts illustrating the control of the ignition system timing.

FIG. 5 illustrates a time chart for the control of ignition timing. The four cylinders in the internal combustion engine E are ignited in a sequence of #2→#1→#3→#4→#2→#1→#3→#4. The calculation of the ignition timing and the judgement of the number of spark plugs ignited in each cylinder are started at a compression-top position in which the ignition timing is preceded, and on the basis of the calculation result, the ignition is carried out in the vicinity of a top dead point immediately before a top of compression of the ignited cylinder. For example, if the switch-over from a two-point ignition to a one-point ignition is determined from the calculation started at the top of compression of the #3 cylinder, the ignition in the next #4 cylinder is switched-over to the one-point ignition.

Figure 6:
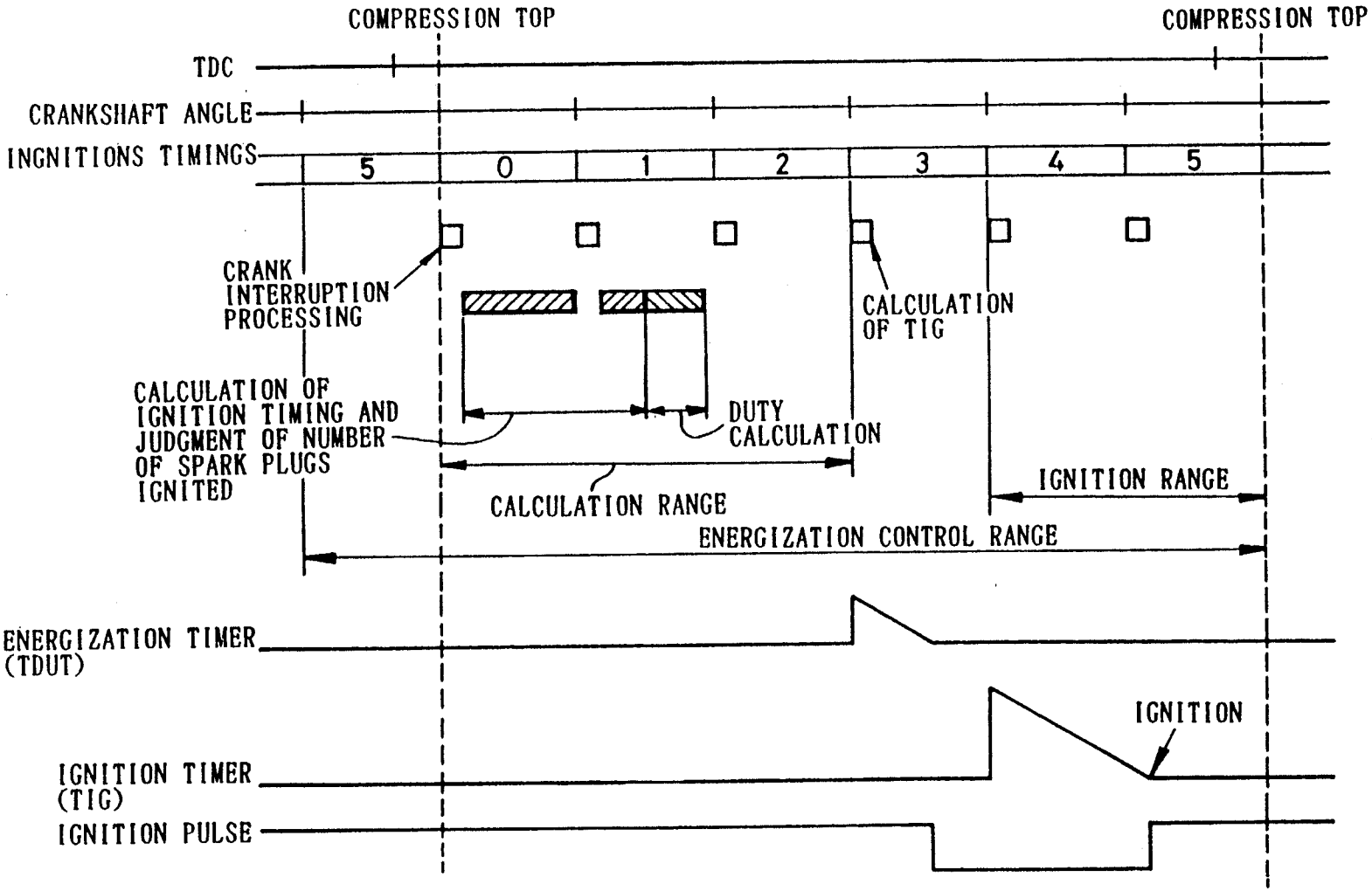

FIG. 6 also illustrates a time chart for the control of the number of spark plugs ignited. In each cylinder, ignition timings "0", "1" and "2" are determined as a range of calculation. For example, the calculation of ignition timing and the judgement of the number of spark plugs to be ignited are carried out in the first half of ignition timings "0" and "1", and a duty calculation is carried out in the second half. In a range of ignition timings "4" and "5", the two-point ignition or the one-point ignition is carried out at a predetermined timing based on the above-described calculation result. More specifically, if the number of spark plugs to be ignited is decided by the judgment of the number of spark plugs previously ignited, the ignition timing is determined from an ignition timing map for the two-point ignition and an ignition timing map for the one-point ignition which correspond to individual cases, and is corrected by an ignition timing correcting value depending upon the operational condition of the internal combustion engine E. An energizing timer and an igniting timer are operated on the basis of the corrected ignition timing, so that each of the two-point ignition and the one-point ignition is carried out at a predetermined timing.

Figure 11:
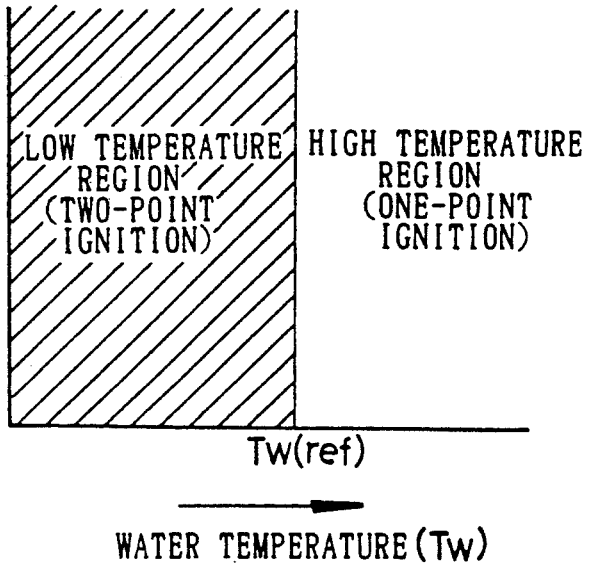
FIG. 11 is a graph illustrating the switch-over of the number of points of ignition in accordance with the temperature of water.

The content of the control of the number of spark plugs ignited will be described with reference to a flow chart shown in FIG. 7. First, at a step S1, the temperature $T_W$ of engine cooling water is read in the electronic control unit U from an output signal from the water temperature sensor $S_3$. Then, it is judged at a step S2 whether or not the internal combustion engine E is in a speed-reduction fuel cutting condition. If the answer is NO, it is judged at a step S3 whether or not the temperature $T_W$ of water is equal to or lower than a reference water temperature $T_W$(ref). If the answer is YES, i.e., if the temperature $T_W$ of water is equal to or lower than a reference water temperature $T_W$ (ref) and the internal combustion engine E is in a low temperature region (see FIG. 11), the two-point ignition is selected at a step S4, so that the intake spark plug $P_{IN}$ and the exhaust spark plug $P_{EX}$ are ignited together by the ignition control means $U_1$. In other words, if it is decided at a step S11 in a flow chart shown in FIG. 8 that the ignition is the two-point ignition, both of the intake spark plug $P_{IN}$ and the normally-ignited exhaust spark plug $P_{EX}$ are ignited by the fact that the output prohibit circuits 29*a* and 29*b* in the ignition control means $U_1$ shown in FIG. 4 are brought into an ignition output logic at a step S12 to permit the ignition of the intake spark plug $P_{IN}$.

Figure 15:
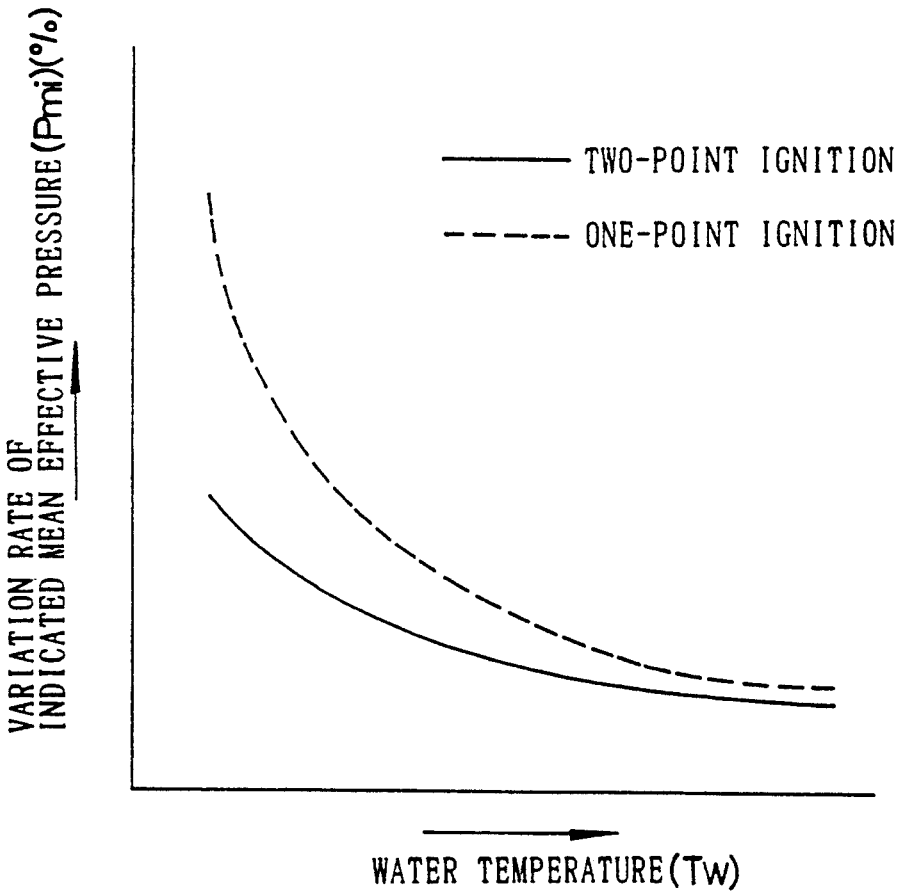
FIG. 15 is a graph illustrating the relationship between the temperature of the engine water and the pressure (Pmi) variation rate.

If the water temperature $T_W$ is in the low temperature region equal to or lower than the reference water temperature $T_W$(ref), the atomization of the fuel deposited on the intake pipe is imperfect, and as a result, not only the fuel firing performance is reduced, but also even if the fuel is fired, a variation in combustion is liable to occur. However, if the spark plugs are brought into the two-point ignition during the low temperature operation of the internal combustion engine E as described above to enhance the fuel firing performance and to increase the fuel combustion speed, it is possible to decrease the variation in combustion without an increase in amount of fuel to reduce the amount of NOx in the low temperature region. FIG. 15 illustrates mean effective pressure variation rates (which will be referred to as a Pmi variation rate hereinafter) provided when the two-point ignition has been performed (shown by a solid line) and when the one-point ignition has been performed (shown by a dashed line) in a lower water temperature condition. It can be seen from FIG. 15 that the Pmi variation rate can be reduced to provide a stable combustion by performing the two-point ignition in the lower water temperature condition.

Figure 7:
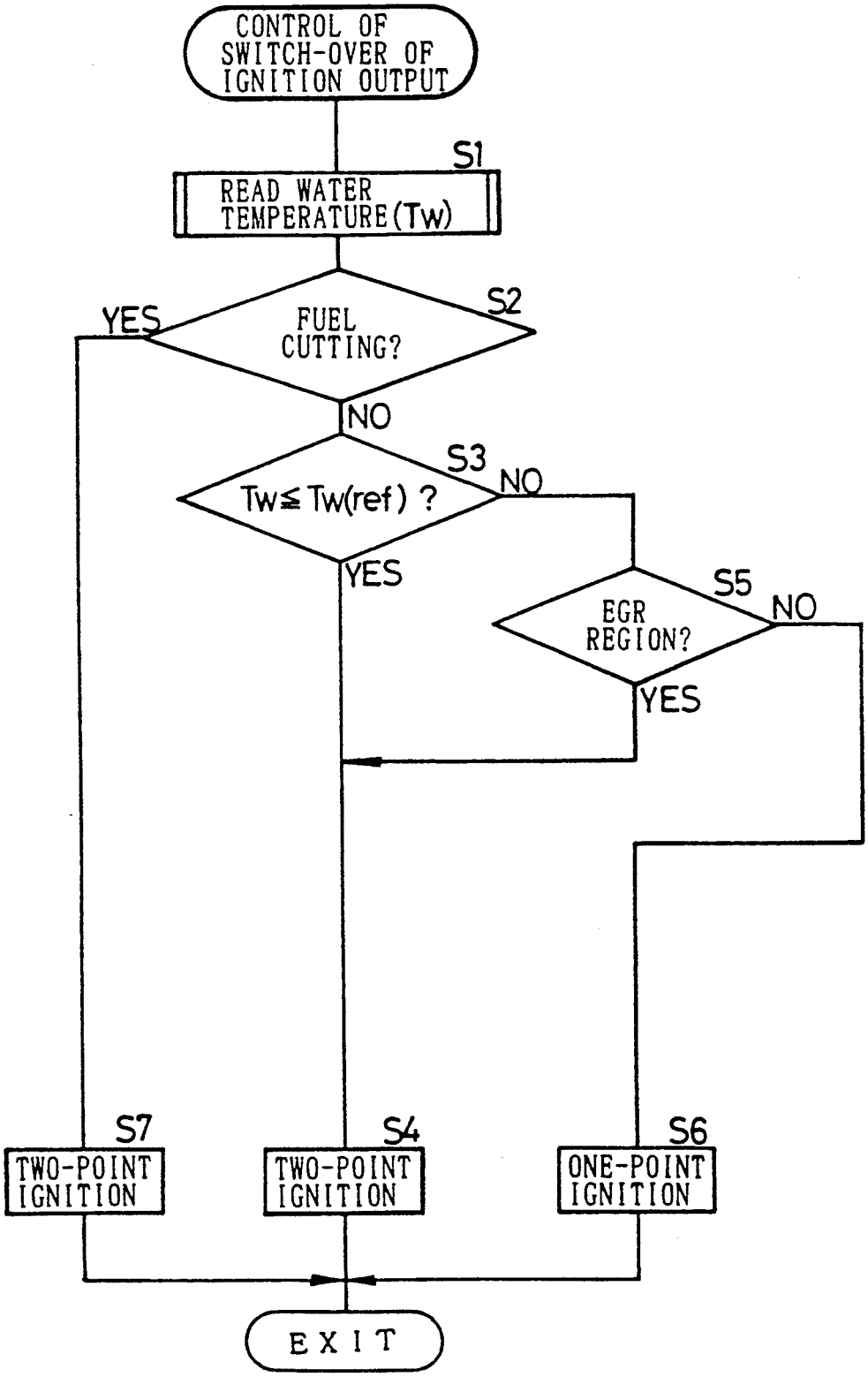
FIG. 7 is a flow chart of a first embodiment of the ignition system.
Figure 8:
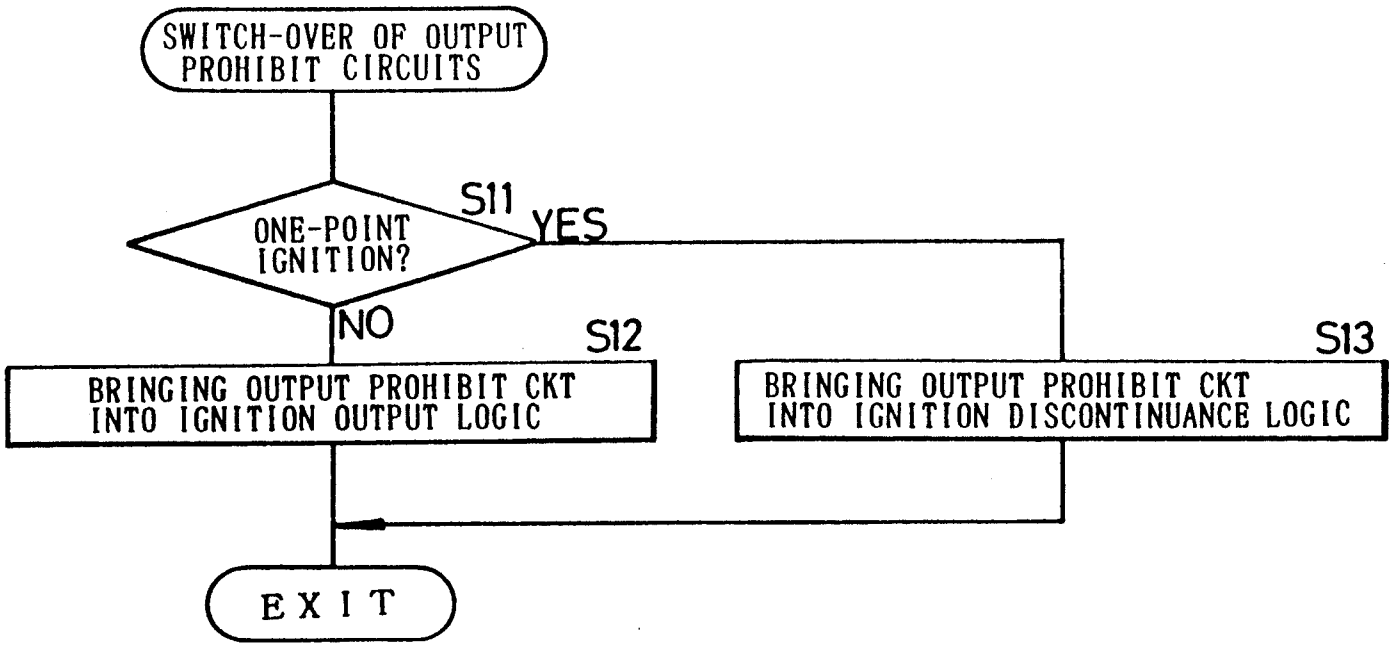
FIG. 8 is a flow chart for switch-over of the number of spark plugs being ignited.
Figure 12:
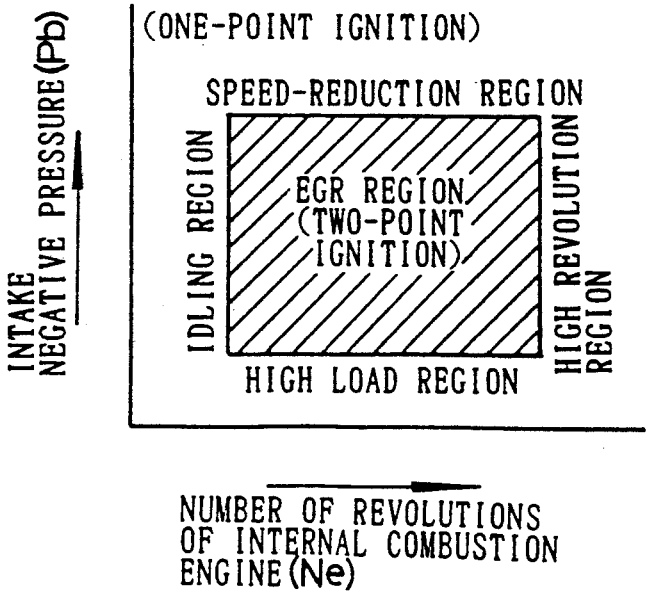
FIG. 12 is a graph illustrating the switch-over of the number of points of ignition in accordance with the number of revolutions of the engine and the intake negative pressure.

If the answer at the step S3 in the flow chart shown in FIG. 7 is NO, i.e., if the temperature $T_W$ of water is in a high temperature region exceeding the reference water temperature $T_W$(ref), it is judged from the number Ne of revolutions of the engine and the intake negative pressure Pb at a step S5 whether or not the internal combustion engine E is in an exhaust gas recirculation (EGR) region (see FIG. 12). If the answer at the step S5 is YES, i.e., if the exhaust gas recirculation (EGR) is being carried out to provide a reduction in amount of NOx, the two-point ignition is selected at a step S4. If the answer at the step S5 is NO, i.e., if the internal combustion engine E is out of the exhaust gas recirculation (EGR) region (i.e., in a high revolution region, in an idling region, a speed-reduction region or in a high load region, as shown in FIG. 12), the one-point ignition is selected at a step S6. In the one-point ignition, only the normally-ignited exhaust spark plug $P_{EX}$ is ignited by the fact that the output prohibit circuits 29*a* and 29*b* in the ignition control means U, shown in FIG. 4 are brought into an ignition discontinuing logic, thereby permitting the ignition of the intake spark plug $P_{IN}$ to be discontinued, as shown at a step S13 in the flow chart in FIG. 8.

Figure 16:
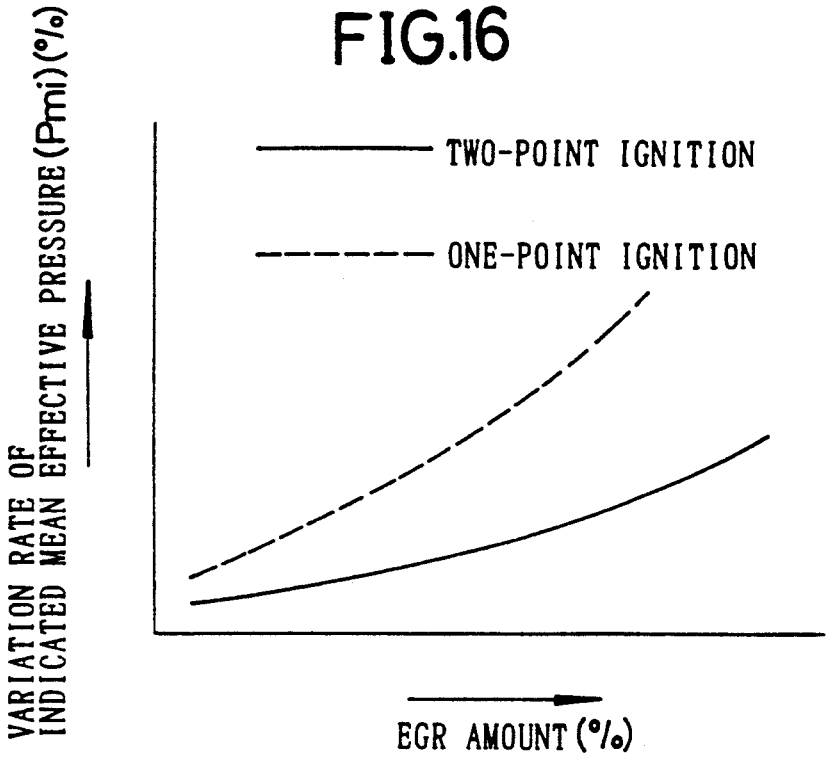
FIG. 16 is a graph illustrating the relationship between the amount of EGR and the Pmi variation rate.
Figure 17:
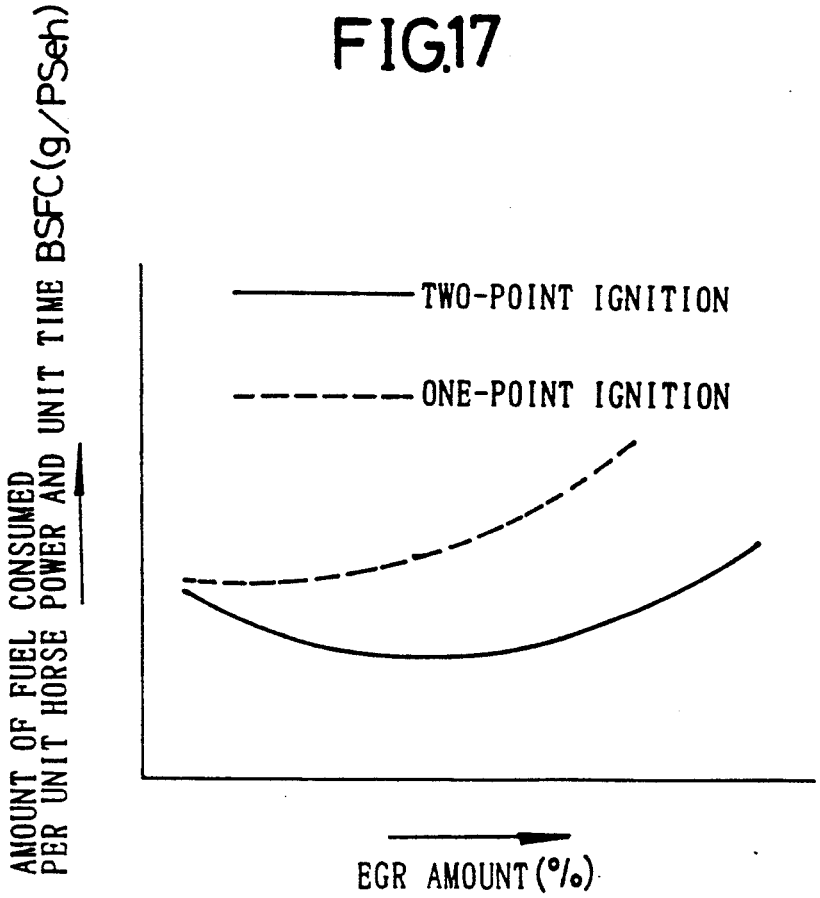
FIG. 17 is a graph illustrating the relationship between the amount of EGR and the amount of fuel consumed.
Figure 18:
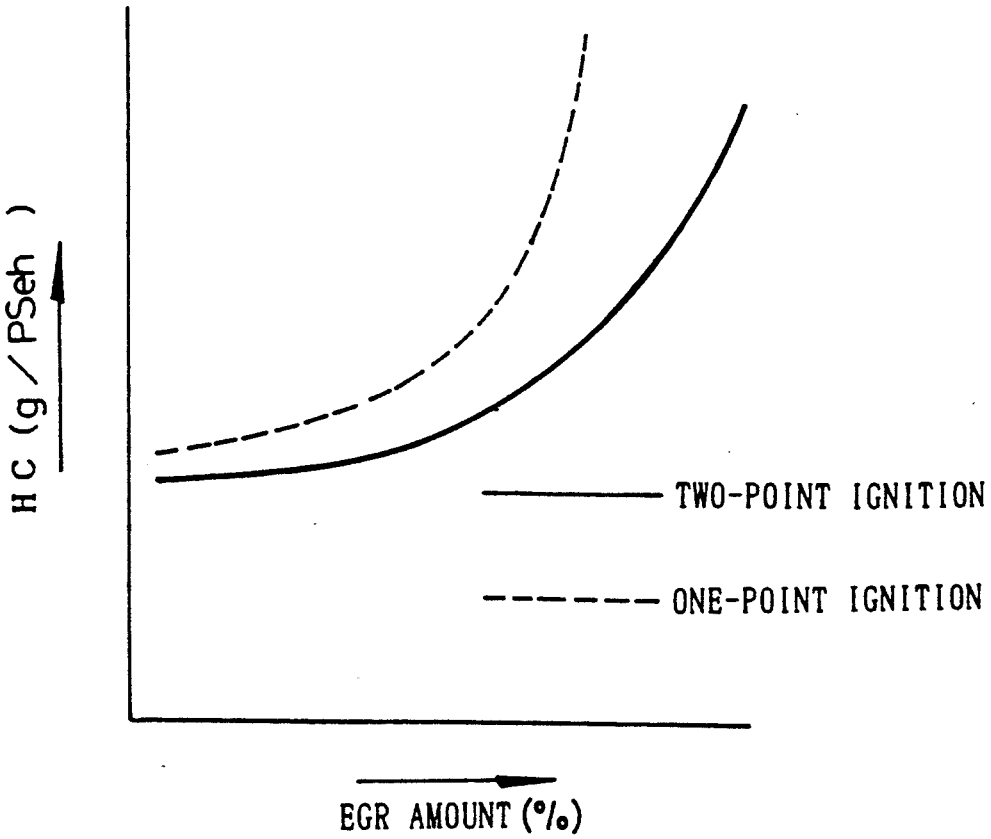
FIG. 18 is a graph illustrating the relationship between the amount of EGR and the amount of HC discharged.

As shown in FIGS. 16, 17 and 18, it can be appreciated that in a region of a large amount of EGR, all of the Pmi variation rate, BSFC (amount of fuel consumed per unit horsepower and unit time) and the amount of HC discharged are reduced by selection of the two-point ignition rather than the one-point ignition. Thereupon, reductions in combustion variation, in fuel consumption and in amount of HC are achieved by selection of the two-point ignition in the EGR region (the region of the large amount of EGR), as described above.

Figure 19:
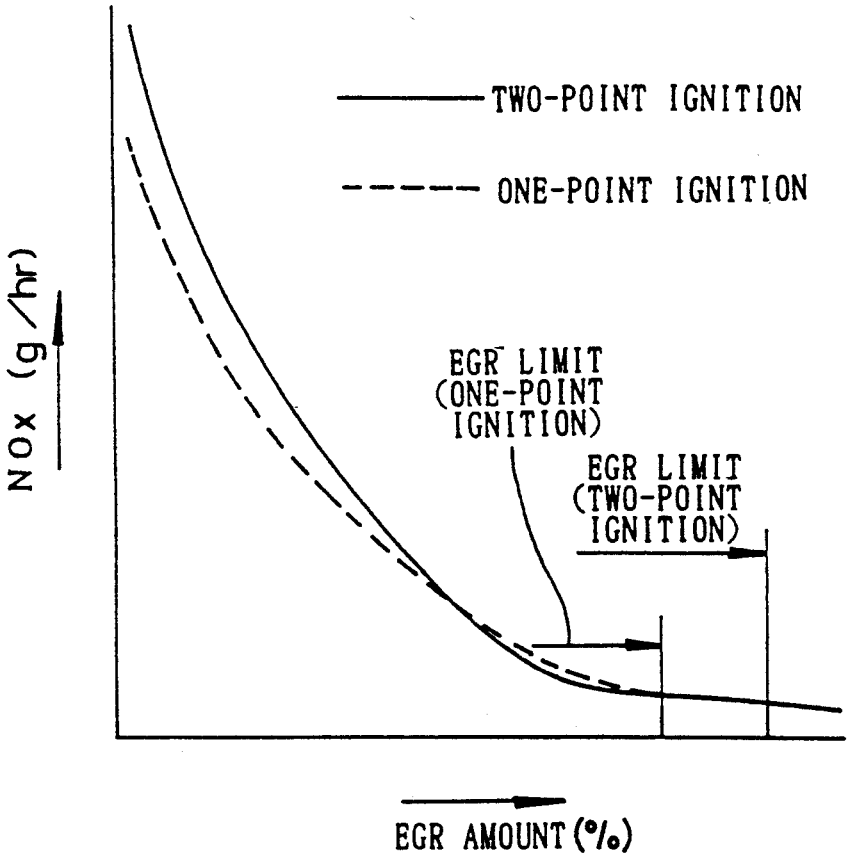
FIG. 19 is a graph illustrating the relationship between the amount of EGR and the amount of NOx discharged.

As shown in FIG. 19, if the two-point ignition is selected in a region out of the high EGR region (i.e., in a region of a small amount of EGR), the combustion speed is too large, and the amount of NOx discharged is reversely increased. Thereupon, a reduction in amount of NOx is achieved by selection of the one-point ignition in the region out of the high EGR region, as described above. Therefore, if the two-point ignition and the one-point ignition are switched over from one to another in the vicinity of a point at which the characteristic shown in FIGS. 16 to 18 and the characteristic shown in FIG. 19 intersect each other, reductions in combustion variation, in fuel consumption and in amounts of HC and NOx discharged can be achieved simultaneously.

If the answer at the step S2 in the flow chart shown in FIG. 7 is YES and the internal combustion engine E is in the speed-reduction fuel cutting condition, the two-point ignition is selected at a step S7. In other words, if the ignition of the spark plug is discontinued during the speed-reduction fuel cutting, there is a fear that the fouling of the spark plug occurs to cause a reduction in firing performance at the restart of firing. However, it is possible to prevent the fouling of the spark plug by preferentially selecting the two-point ignition to energize even the inherent inoperative spark plug during the speed-reduction fuel cutting.

The operation of the second embodiment of the present invention will be described below.

Figure 9:
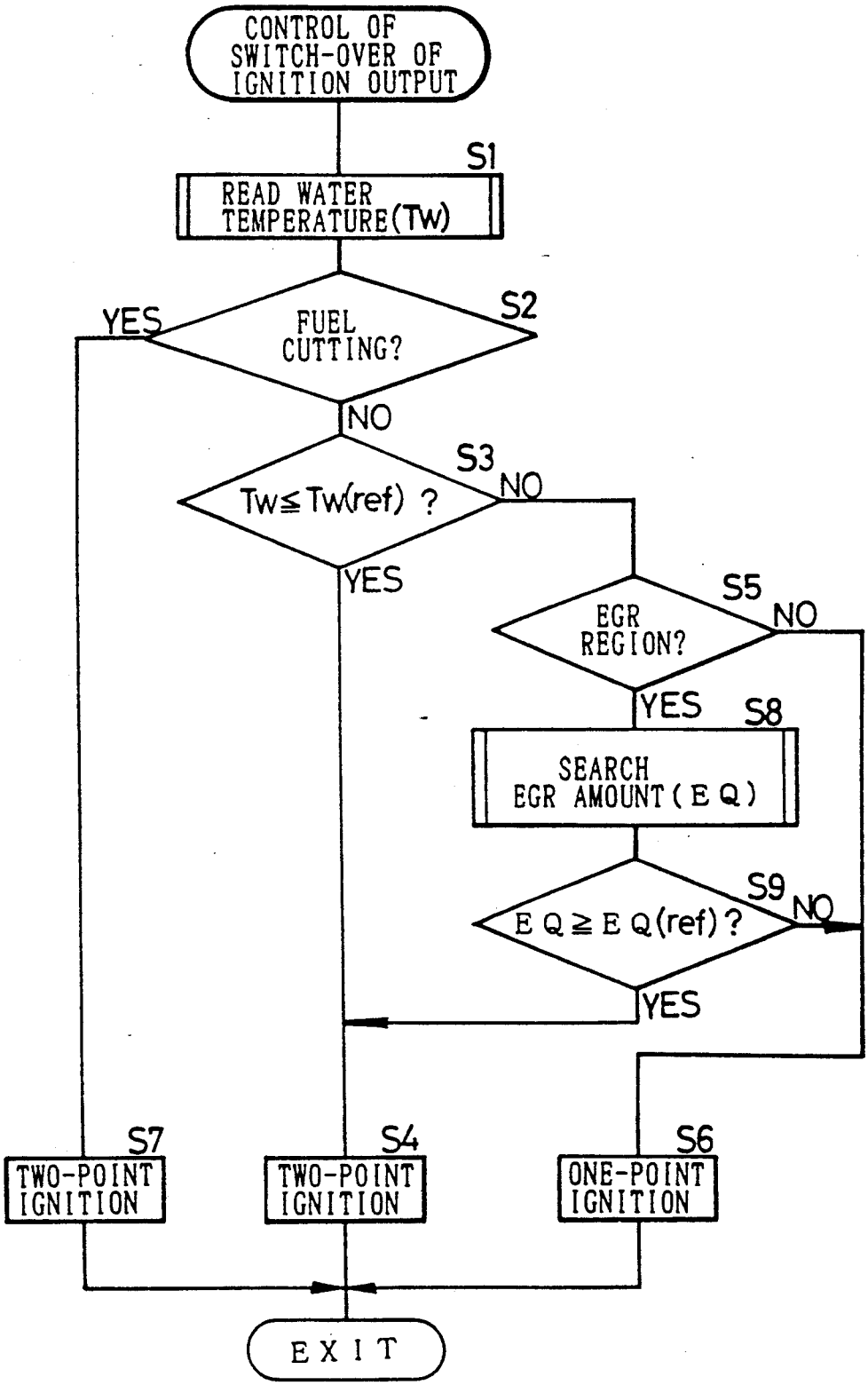
FIG. 9 is a flow chart of a second embodiment of the ignition system.

FIG. 9 illustrates a flow chart of the second embodiment. This embodiment has the basic feature that the two-point ignition and the one-point ignition are switched over from one to the other on the basis of the amount of EGR (see steps S8 and S9), and in all other respects this flow chart is the same as the flow chart in FIG. 7.

Figure 13:
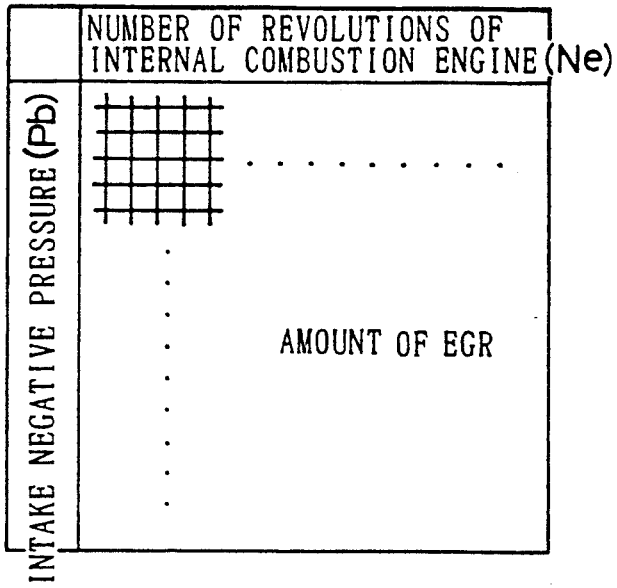
FIG. 13 is a map for determining the amount of EGR from the number of revolutions of the engine and the intake negative pressure.

More specifically, if it has been decided at the step S5 that the internal combustion engine E is in the EGR region, the amount EQ of EGR is searched in a map from the number Ne of revolutions of engine and the intake negative pressure Pb at the step S8 (see FIG. 13). If the amount EQ of EGR is equal to or larger than a reference recirculation amount EQ (ref), the two-point ignition is selected at the step S4. If the amount EQ of EGR is smaller than the reference recirculation amount EQ (ref), the one-point ignition is selected at the step S6. In this way, it is possible to perform a further accurate control by switching over the two-point ignition and the one-point ignition from one to another in consideration of not only whether or not the internal combustion engine E is in the EGR region, but also the amount EQ of EGR.

A third embodiment of the present invention will now be described.

Figure 10:
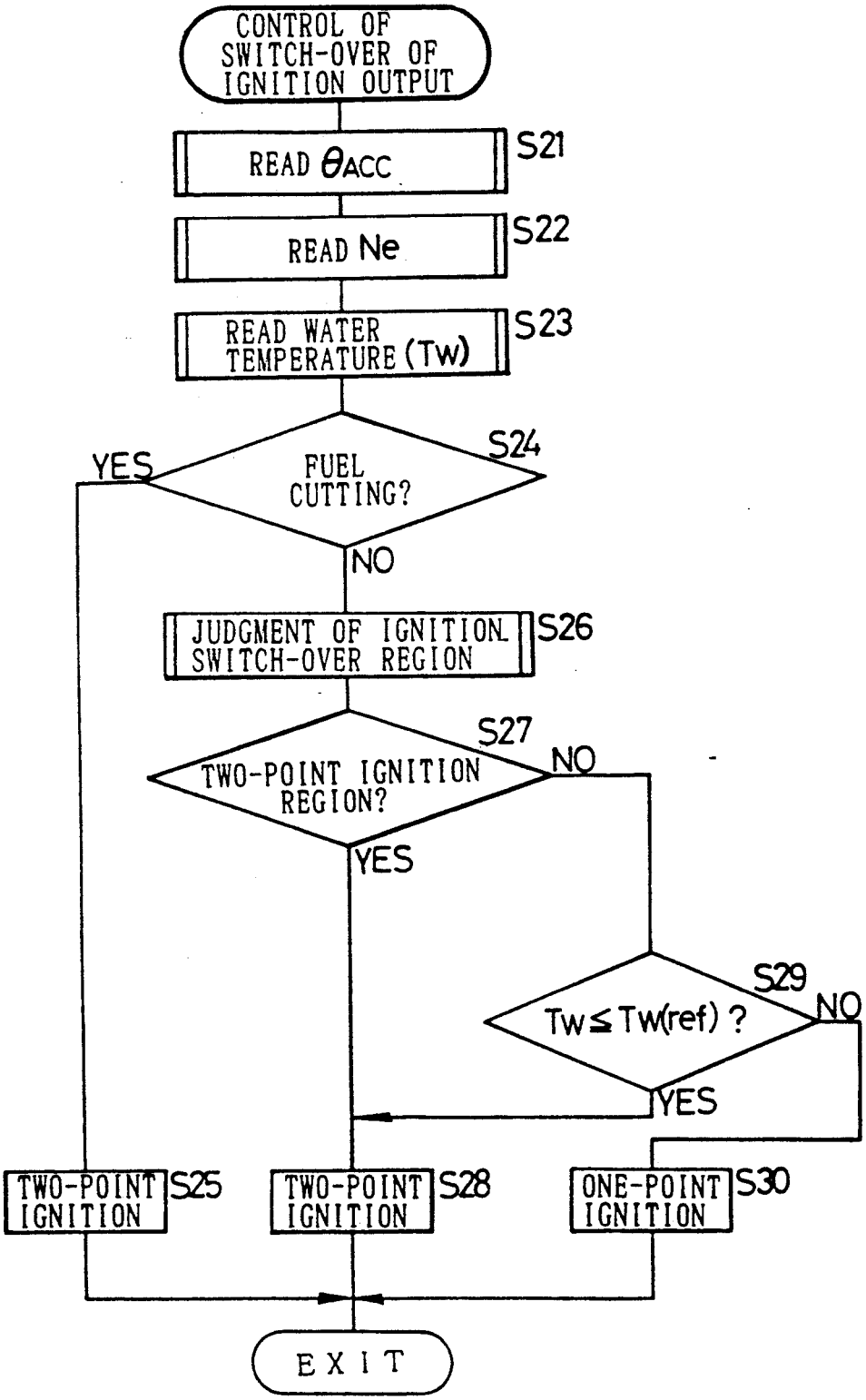
FIG. 10 is a flow chart of a third embodiment of the ignition system.

FIG. 10 illustrates a flow chart of the third embodiment. This embodiment has the basic feature that the two-point ignition and the one-point ignition are switched over from one to another in accordance with the load on the internal combustion engine E.

First, the throttle opening degree $\Theta_{ACC}$ is read in the electronic control unit U from the throttle opening degree sensor $S_2$ at a step S21; the number Ne of revolutions of the engine is read in the electronic control unit U from the engine revolution number sensor $S_1$ at a step S22, and the temperature $T_W$ of water is read in the electronic control unit U from the water temperature sensor $S_4$ at a step S23. Then, it is judged at a step S24 whether or not the internal combustion engine E is in the speed-reduction fuel cutting condition. If the answer at the step S24 is YES, the two-point ignition is likewise selected unconditionally at a step S25.

Figure 14:
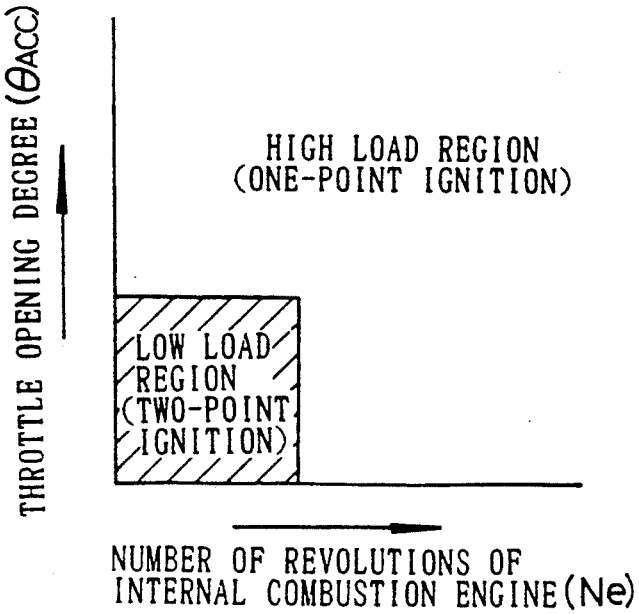
FIG. 14 is a graph illustrating the switch-over of the number of points of ignition to another number in accordance with the number of revolutions of the engine and the throttle opening degree.

If the answer at the step S24 is NO, i.e., the internal combustion engine E is not in the speed-reduction fuel cutting condition, the judgement of an ignition switch-over region is performed at a step S26, where the magnitude of the load on the internal combustion engine E is judged from the throttle opening degree $\Theta_{ACC}$ and the number Ne of revolutions of the engine (see FIG. 14). If it is decided at a step S27 that the internal combustion engine E is in a low load region, i.e., in a two-point ignition region, the two-point ignition is selected at a step S28. If it is decided at the step S27 that the internal combustion engine E is in a high load region, i.e., in a one-point ignition region, it is judged at a step S29 whether or not the temperature $T_W$ of water is equal to or lower than the reference water temperature $T_W$(ref). If the temperature $T_W$ of water is in the low temperature region, the two-point ignition is selected at the step S28. If temperature $T_W$ of water is in the high temperature region, the one-point ignition is selected at a step S30.

The internal combustion engine E of the present embodiment is controlled so that the period of opening of the intake valve $V_{IN}$ is shortened by the hydraulic pressure release valve 10 in a low load region such as the idling region. Thus, the intake valve $V_{IN}$ is closed considerably before completion of an intake stroke, and the temperature of the intake gas is reduced by an adiabatic expansion at a final portion of the intake stroke. As a result, the temperature of the intake gas cannot be risen sufficiently by an adiabatic compression at a subsequent compression stroke, and a reduction in fuel firing performance and a reduction in combustion speed are liable to be produced. However, it is possible to stabilize the combustion by bringing the spark plugs into the two-point ignition in the low load region of the internal combustion engine E to provide an enhanced firing performance of the fuel. In addition, in the high load region, the period of opening of the intake valve $V_{IN}$ is prolonged to sufficiently increase the compression temperature of the intake gas, resulting in a problem that the combustion temperature is increased excessively to cause an increase in the amount of NOx discharged. However, it is possible to prevent the increase in the combustion temperature to avoid the increase in the amount of NOx discharged, by bringing the spark plugs into the one-point ignition condition in the high load region of the internal combustion engine, as described above.

Figure 20:
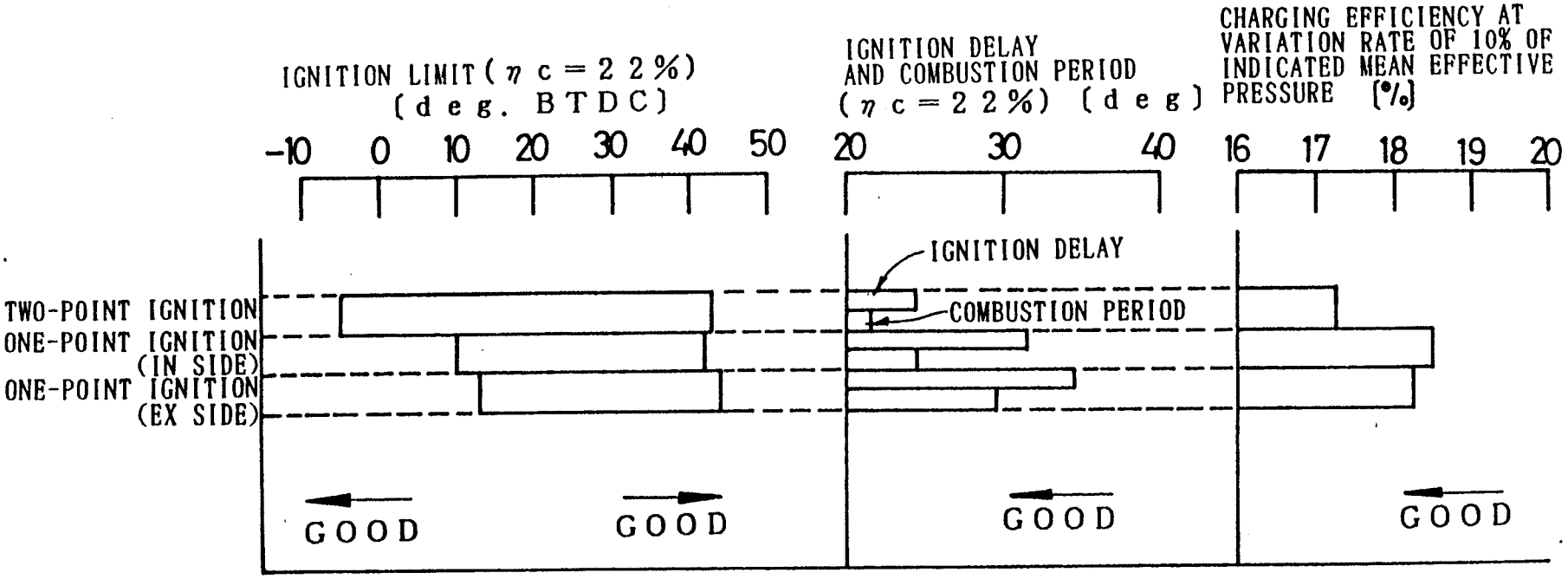
FIG. 20 is a graph illustrating the effect of a two-point ignition when the load on the engine is low.

FIG. 20 is a graph showing the ignition timing limit (the advance limit is an ignition timing at which a misfiring occurs, and the delay limit is an ignition timing at which the Pmi variation is at least 7.5%), the ignition delay and the combustion period (the ignition delay is a crank angle from the ignition timing to a mass combustion rate of 10%, and the combustion period is a crank angle from the mass combustion rate of 10% to a mass combustion rate of 90%), and the charging efficiency $\eta_c$ at the Pmi variation rate of 10%, when the two-point ignition and the one-point ignition (IN and EX sides) have been performed during the low load operation of the engine. It can be seen from this graph that the ignition limit, the ignition delay, the combustion period and the charging efficiency are all improved by selecting the two-point ignition during the low load operation of the engine.

Figure 21:
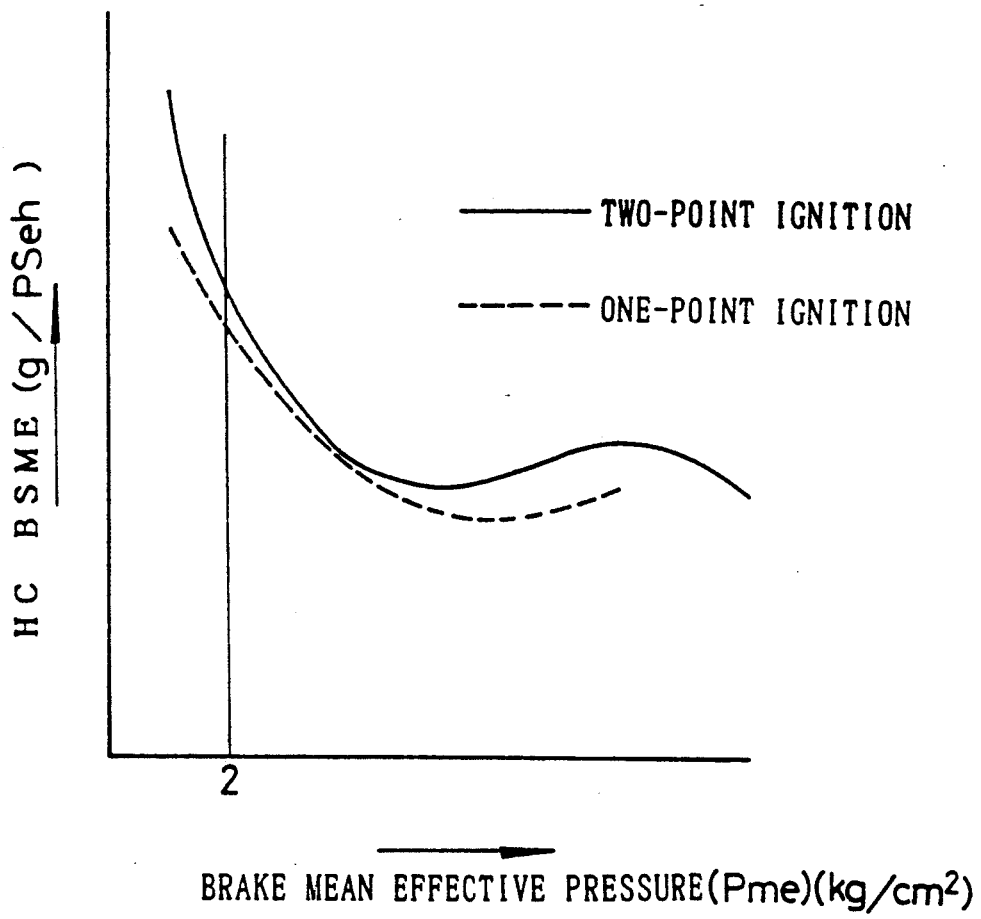
FIG. 21 is a graph illustrating the relationship between the brake mean effective pressure and the amount of HC discharged.
Figure 22:
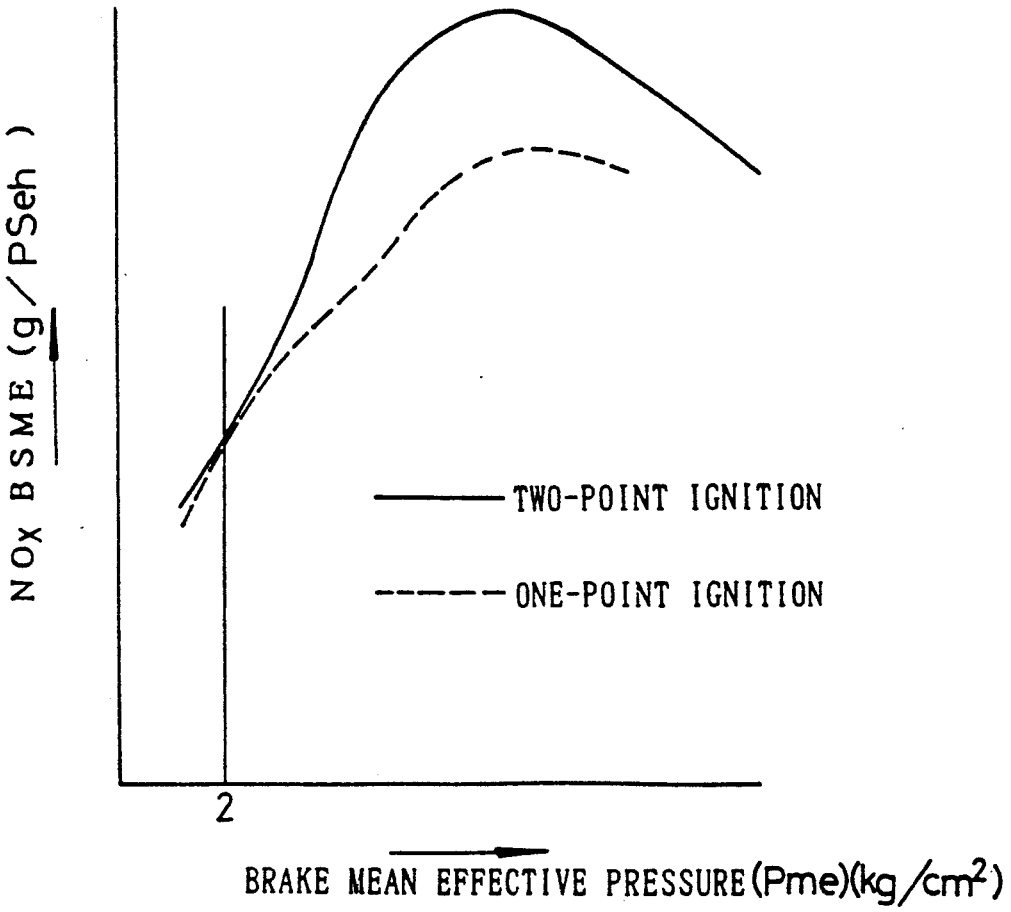
FIG. 22 is a graph illustrating the relationship between the brake mean effective pressure and the amount of NOx discharged.
Figure 23:
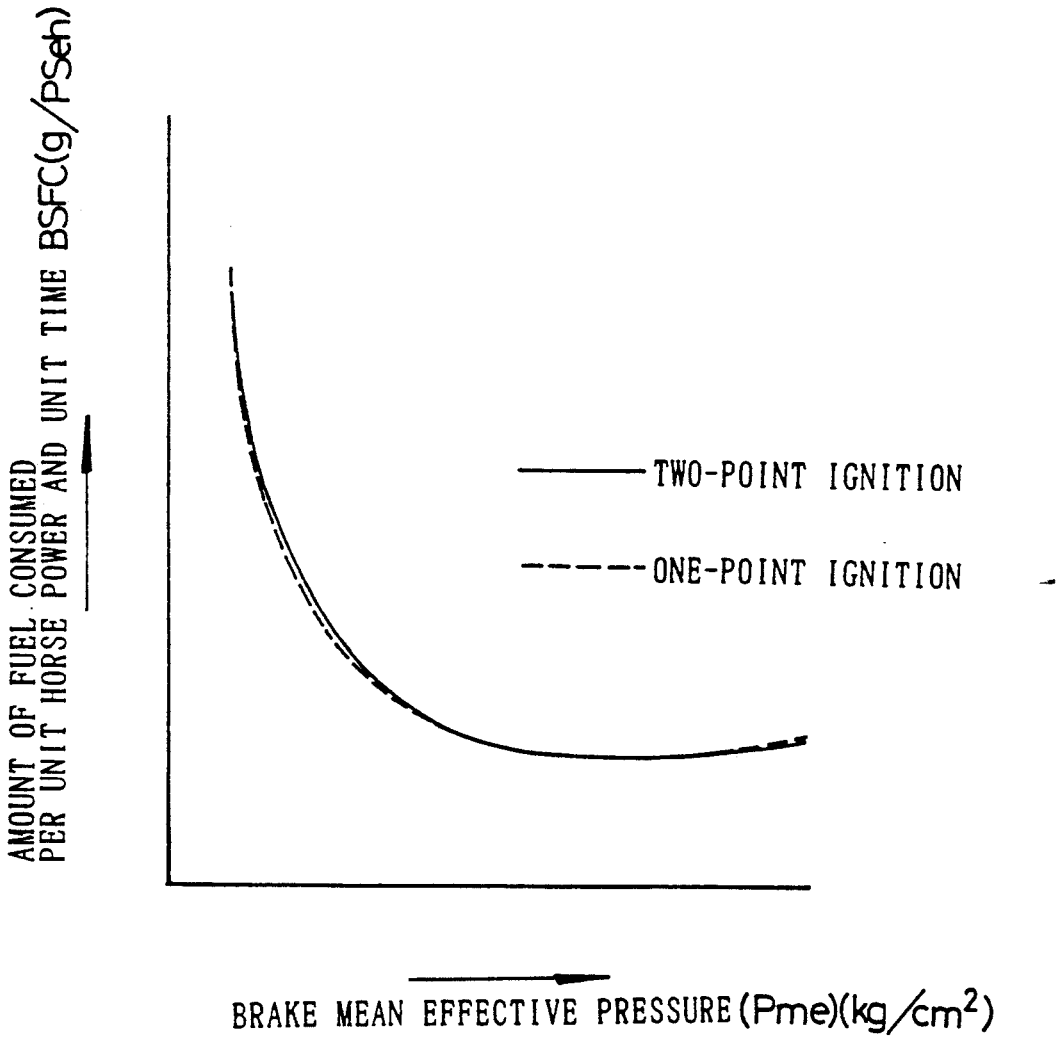
FIG. 23 is a graph illustrating the relationship between the brake mean effective pressure and the amount of fuel consumed.

FIGS. 21, 22 and 23 are graphs showing the results of measurement of the amounts of HC and NOx discharged and the amount of fuel consumed BSFC under conditions of an engine revolution number of 2,000 rpm, an air-fuel ratio of 14.7 and MBT ignition in the cases of the two-point ignition and the one-point ignition. As apparent from FIGS. 21 and 22, in a high load region in which the brake mean effective pressure exceeds 2 kg/cm$^2$, both the amounts of HC and NOx discharged in the two-point ignition tend to be higher than those in the one-point ignition. As apparent from FIG. 23, a large difference in BSFC is not observed between the two-point ignition and the one-point ignition. It can be appreciated from this fact that the amounts of HC and NOx discharged can be reduced without an increase in amount of fuel consumed by selecting the one-point ignition in the high load region.

A fourth embodiment of the present invention will be described below.

In the above-described first, second and third embodiments, with the intake spark plug $P_{IN}$ and the exhaust spark plug $P_{EX}$ mounted for each of the cylinders, the exhaust spark plug $P_{EX}$ is normally ignited, and the ignition of the intake spark plug $P_{IN}$ is discontinued. However, if only the ignition of the intake spark plug $P_{IN}$ is discontinued, a problem is encountered that a large difference in number of ignitions between the intake spark plug $P_{IN}$ and the exhaust spark plug $P_{EX}$ is produced for a long period of time, resulting in an unbalance in durability between the intake spark plug $P_{IN}$ and the exhaust spark plug $P_{EX}$. If only the ignition of the intake spark plug $P_{IN}$ is discontinued, there is a possibility that a fouling is produced in the intake spark plug $P_{IN}$, resulting in an adversely affected firing performance.

Thus, in a fourth embodiment, the operation of the output prohibit circuits 29*a* and 29*b* for the intake spark plug $P_{IN}$ and the operation of the output prohibit circuits 29*c* and 29*c* for the exhaust spark plug $P_{EX}$ in FIG. 4 are switched over from one to another at intervals of a predetermined period of time based on a timer or a counter, so that the intake spark plug $P_{IN}$ and the exhaust spark plug $P_{EX}$ in FIG. 4 are alternately put out of operation, thereby overcoming the above problem. This embodiment is particularly effective when it is applied to an engine such as a dilute combustion engine, a pumping-loss reduction engine and a mass EGR engine in which the combustion itself is liable to become improper.

Figure 24A:
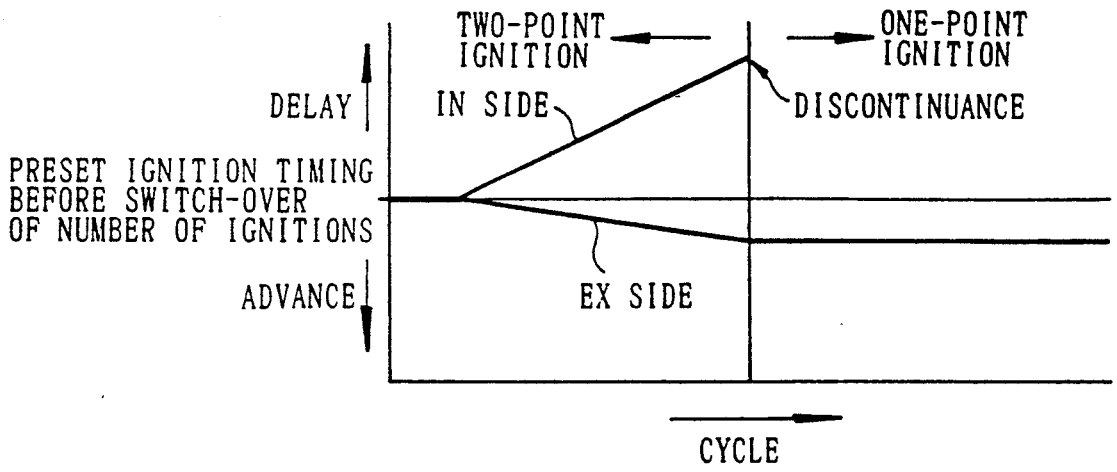
FIGS. 24A and 24B are graphs illustrating the control of the ignition timing, when the number of points of ignition is switched over to another number.
Figure 24B:
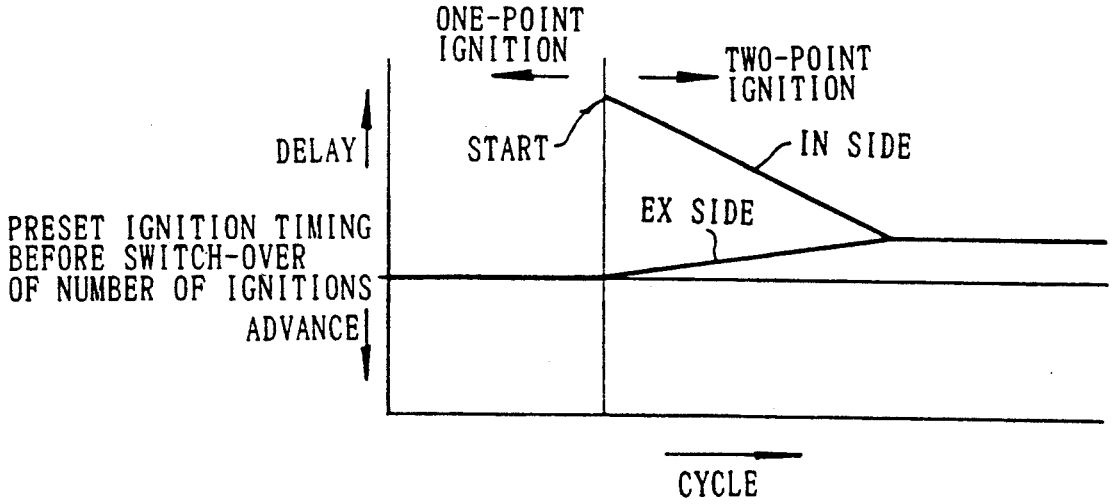

In the above-described first to fourth embodiments, it is desirable to perform the correction of the ignition timing as shown in FIGS. 24A and 24B, when the two-point ignition and the one-point ignition are switched over from one to another. More specifically, in switching-over the two-point ignition to the one-point ignition, the ignition timing of the spark plug to be put out of operation is gradually delayed and then, such spark plug is put out of operation. In switching-over the one-point ignition to the two-point ignition, the ignition of the spark plug which is out of operation is started in a delayed condition and then, the ignition timing of such spark plug is gradually advanced. The variation in output from the internal combustion engine E can be suppressed by correcting the ignition timing in this manner when the two-point ignition and the one-point ignition are switched over from one to another. Alternatively, when the two-point ignition and the one-point ignition are switched over from one to another, it is possible to suppress the variation in output from the internal combustion engine E by utilizing a correction of the amount of fuel injected and a correction of the amount of air admitted by the throttle valve in combination.

Although the embodiments of the present invention have been described above in detail, it will be understood that the present invention is not intended to be limited to these embodiments, and various minor modifications in design can be made without departing from the spirit and scope of the invention defined in claims.

Figure 25:
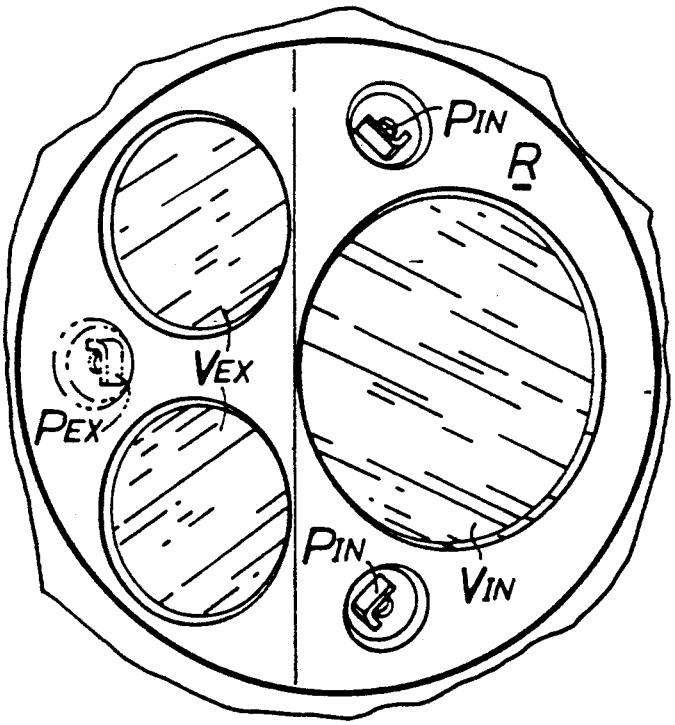
FIG. 25 is a view similar to FIG. 3, but illustrating another layout of spark plugs in the ceiling of the combustion chamber.

For example, although an internal combustion engine having two spark plugs has been shown and described in the embodiments, the present invention is applicable to an internal combustion engine such as that shown in FIG. 25, which is different in both the number of spark plugs and in layout from the above-described embodiments. In addition, although the ignition of the intake spark plug is discontinued in the first to third embodiments, the ignition of the exhaust spark plug may be discontinued. Further, the ignition control means is not limited to a distributorless co-explosion type, and may be of a distributorless independent ignition type or distributor type.

What is claimed is:

1. An ignition system for an internal combustion engine, having at least two spark plugs for each cylinder, the number of spark plugs ignited being controlled in accordance with an operational condition of the engine, wherein said system includes an ignition control means for controlling the ignition in such a manner that an all-point ignition in which all said spark plugs are ignited is carried out in a condition where the temperature of the engine is equal to or lower than a predetermined value, and that a decreased number-point ignition in which the ignition of at least one of said spark plugs is discontinued is carried out in a condition where the temperature of the engine is higher than said predetermined value.

2. An ignition system for an internal combustion engine, having at least two spark plugs for each cylinder, the number of spark plugs ignited being controlled in accordance with an operational condition of the engine, wherein said system includes an ignition control means for controlling the ignition in such a manner that an all-point ignition in which all said spark plugs are ignited is carried out in a condition where an amount of EGR is equal to or more than a predetermined value.

3. An ignition system for an internal combustion engine, having at least two spark plugs for each cylinder and an intake valve opening and closing control mechanism for controlling the opening and closing timing of an intake valve to control an amount of air drawn into the cylinder in accordance with a required load, the number of spark plugs ignited being controlled in accordance with an operational condition of the engine, wherein said system includes an ignition control means for controlling the ignition in such a manner that an all-point ignition in which all said spark plugs are ignited is carried out in a condition where the load on the engine is equal to or lower than a predetermined value, and a reduced number-point ignition in which the ignition of at least one of said spark plugs is discontinued is carried out in a condition where the load on the engine is higher than the predetermined value.

4. An ignition system for an internal combustion engine according to claim 3, wherein said ignition control means performs the all-point ignition, irrespective of the load on the engine, in a condition where the temperature of the engine is equal to or lower than a predetermined value.

5. An ignition system for an internal combustion engine according to any of claims 1 to 4, wherein said ignition control means performs the all-point ignition, irrespective of the engine temperature and load on the engine, when the engine is in a fuel-cutting condition.

6. An ignition system for an internal combustion engine, having at least two spark plugs for each cylinder, the ignition of at least one of the spark plugs being discontinued in accordance with the operational condition of the engine, wherein said system includes an ignition control means for controlling the ignition to alternate the discontinuance of ignition of one spark plug with that of another spark plug in that cylinder at predetermined intervals.

7. An ignition system for an internal combustion engine having at least two spark plugs for each cylinder, comprising:

means for sensing operational conditions of the engine, ignition control means for selectively causing all-point ignition of all of the spark plugs and decreased number-point ignition where less than all of the spark plugs are ignited;

means for causing operation of said ignition control means for selecting between all-point and decrease-point ignition in response to the operational conditions sensed by said sensing means for minimizing at least one of:

(i) variations in fuel combustion;

(ii) fuel consumed per unit of horsepower and unit of time;

(iii) hydrocarbons in exhaust gases; and (iv) nitrous oxides in exhausts of the engine.

8. An ignition system according to claim 7, wherein said all-point ignition is selected when an engine operational condition of engine temperature is less than a predetermined value.

9. An ignition system according to claim 8, wherein said decreased-point ignition is selected when said engine temperature is above said predetermined value.

10. An ignition system according to claim 7, wherein said all-point ignition is selected when an engine operation condition of an amount of EGR determined is equal to or more than a predetermined value.

11. An ignition system according to claim 7, wherein said all-point ignition is selected when an engine operational condition of load on the engine is lower than a predetermined value and said decreased number-point ignition is selected when the load on the engine is higher than said predetermined value.

12. An ignition system according to claim 11, wherein said ignition control means selects the all-point ignition, irrespective of the load on the engine, in a condition where the temperature of the engine as sensed by said sensing means is equal to or lower than a predetermined value.

13. An ignition system according to any of claims 7 to 12, wherein said ignition control means selects the all-point ignition, irrespective of the engine temperature and load on the engine, when the engine is in a fuel-cutting condition.

14. An ignition system according to claim 1, wherein said ignition control means alternates the discontinuance of ignition of one spark plug with that of another spark plug in that cylinder at predetermined intervals in said decreased number-point ignition.

* * * * *